US010775060B2

(12) United States Patent
Takenaka et al.

(10) Patent No.: US 10,775,060 B2
(45) Date of Patent: Sep. 15, 2020

(54) AIR-CONDITIONING APPARATUS

(71) Applicant: MITSUBISHI ELECTRIC CORPORATION, Chiyoda-ku (JP)

(72) Inventors: Naofumi Takenaka, Chiyoda-ku (JP); Shinichi Wakamoto, Chiyoda-ku (JP); Kazuya Watanabe, Chiyoda-ku (JP); Koji Yamashita, Chiyoda-ku (JP); Takeshi Hatomura, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 680 days.

(21) Appl. No.: 15/030,500

(22) PCT Filed: May 1, 2014

(86) PCT No.: PCT/JP2014/062106
§ 371 (c)(1),
(2) Date: Apr. 19, 2016

(87) PCT Pub. No.: WO2015/059945
PCT Pub. Date: Apr. 30, 2015

(65) Prior Publication Data

US 2016/0273795 A1 Sep. 22, 2016

(30) Foreign Application Priority Data

Oct. 24, 2013 (JP) ..... 2013-220771

(51) Int. Cl.
*F24F 11/00* (2018.01)
*F25B 47/02* (2006.01)
(Continued)

(52) U.S. Cl.
CPC ..... *F24F 11/30* (2018.01); *F24F 13/30* (2013.01); *F25B 13/00* (2013.01); *F25B 41/043* (2013.01);
(Continued)

(58) Field of Classification Search
CPC ..... F25B 2313/0233; F25B 2313/006; F25B 2313/0253; F25B 47/022; F25B 43/006
See application file for complete search history.

(56) References Cited

U.S. PATENT DOCUMENTS 4,770,000 A * 9/1988 Kuroda ..... F25B 13/00 62/156
5,651,265 A * 7/1997 Grenier ..... F24J 3/081 165/45
(Continued)

FOREIGN PATENT DOCUMENTS

CN 102272534 A 12/2011
JP 2003-4329 A 1/2003
(Continued)

OTHER PUBLICATIONS

Extended European Search Report dated May 18, 2017 in Patent Application No. 14855634.3.
(Continued)

*Primary Examiner* — Nelson J Nieves
*Assistant Examiner* — Meraj A Shaikh
(74) *Attorney, Agent, or Firm* — Xsensus LLP

(57) ABSTRACT

An air-conditioning apparatus is capable of performing a heating-defrosting operation where a specific one of a plurality of parallel heat exchangers is a heat exchanger to be defrosted and serves as a condenser while at least one parallel heat exchanger other than the heat exchanger to be defrosted serves as an evaporator. The air-conditioning apparatus includes a liquid refrigerant transporting unit for transferring liquid refrigerant from an accumulator to the heat exchanger to be defrosted. To perform the heating-defrosting operation, the air-conditioning apparatus sup-
(Continued)

plies, to the heat exchanger to be defrosted, the liquid refrigerant transferred by the liquid refrigerant transporting unit.

20 Claims, 15 Drawing Sheets

(51) Int. Cl.

| | |
|---|---|
| ***F25B 43/00*** | (2006.01) |
| ***F25B 13/00*** | (2006.01) |
| ***F24F 13/30*** | (2006.01) |
| ***F24F 11/30*** | (2018.01) |
| ***F25B 41/04*** | (2006.01) |
| *F24F 11/42* | (2018.01) |
| *F24F 140/12* | (2018.01) |
| *F24F 140/20* | (2018.01) |

(52) U.S. Cl.
CPC ..... *F25B 43/006* (2013.01); *F25B 47/022* (2013.01); *F24F 11/42* (2018.01); *F24F 2140/12* (2018.01); *F24F 2140/20* (2018.01); *F25B 2313/006* (2013.01); *F25B 2313/0233* (2013.01); *F25B 2313/0251* (2013.01); *F25B 2313/0253* (2013.01); *F25B 2341/062* (2013.01); *F25B 2600/25* (2013.01)

(56) References Cited

U.S. PATENT DOCUMENTS

| | | | | |
|---|---|---|---|---|
| 5,996,360 | A | 12/1999 | Tanaka et al. | |
| 2005/0257558 | A1* | 11/2005 | Yoshioka | B82Y 30/00 62/324.5 |
| 2009/0056358 | A1* | 3/2009 | Kotani | F24F 5/0017 62/259.1 |
| 2011/0232308 | A1 | 9/2011 | Morimoto et al. | |
| 2013/0098092 | A1* | 4/2013 | Wakamoto | F25B 1/10 62/278 |

FOREIGN PATENT DOCUMENTS

| | | | | |
|---|---|---|---|---|
| JP | 2003004329 | A | * | 1/2003 |
| JP | 2006-78087 | A | | 3/2006 |
| JP | 2008-157558 | A | | 7/2008 |
| JP | 2008157558 | A | * | 7/2008 |
| JP | 2009-085484 | A | | 4/2009 |
| JP | 2010/082325 | A1 | | 7/2010 |
| JP | 2010-203673 | A | | 9/2010 |
| WO | 2012/014345 | A1 | | 2/2012 |

OTHER PUBLICATIONS

International Search Report dated Jul. 22, 2014, in PCT/JP2014/062106 Filed May 1, 2014.

Combined Chinese Office Action and Search Report dated Mar. 30, 2017 in Patent Application No. 201480058083.8 (with partial English translation and English translation of categories of cited documents).

Combined Office Action and Search Report dated Aug. 15, 2017 in Chinese Patent Application No. 201480058083.8 (with partial English language translation and English translation of categories of cited documents).

* cited by examiner

AIR-CONDITIONING APPARATUS

TECHNICAL FIELD

The present invention relates to an air-conditioning apparatus that performs a defrosting operation during heating.

BACKGROUND ART

In recent years, from the viewpoint of global environmental protection, an increasing number of boiler type heaters that burn fossil fuels for heating have been replaced, even in cold climate areas, by heat pump type air-conditioning apparatuses that use air as a heat source.

The heat pump type air-conditioning apparatus can provide efficient heating, because heat is supplied from air as well as from electricity input to a compressor.

However, when the outdoor air temperature drops, frost forms on an outdoor heat exchanger serving as evaporator, and hence a defrosting operation needs to be performed to melt the frost on the outdoor heat exchanger.

The defrosting operation may be done by reversing the refrigeration cycle. However, this leads to discomfort, because indoor heating is suspended during the defrosting operation.

To perform a heating operation during defrosting, a technique that involves dividing the outdoor heat exchanger has been proposed. In this technique, during defrosting of one of the resulting heat exchangers, the other at least one heat exchanger serves as an evaporator to receive heat from air for heating (see, e.g., Patent Literatures 1, 2, and 3).

In the technique described in Patent Literature 1, an outdoor heat exchanger is divided into two heat exchanger units. For defrosting of one of the heat exchanger units, an electronic expansion valve provided upstream of the heat exchanger unit to be defrosted is closed. Then, a solenoid on/off valve in a bypass pipe that allows refrigerant to flow from a discharge pipe of a compressor to the inlet of the heat exchanger unit is opened, so that a part of high-temperature refrigerant discharged from the compressor directly flows into the heat exchanger unit to be defrosted. When the defrosting of one of the heat exchanger units ends, defrosting of the other heat exchanger unit is performed.

In this case, the defrosting of the heat exchanger unit to be defrosted is performed, with the pressure of refrigerant in the heat exchanger unit being equal to the suction pressure of the compressor (low-pressure defrosting).

The technique described in Patent Literature 2 involves using a plurality of heat source units and at least one indoor unit. Only in the heat source unit that includes a heat-source-side heat exchanger to be defrosted, the connection of a four-way valve is made opposite to that during heating, so that the refrigerant discharged from the compressor directly flows into the heat-source-side heat exchanger.

In this case, defrosting of the heat-source-side heat exchanger to be defrosted is performed, with the pressure of refrigerant in the heat-source-side heat exchanger being equal to the discharge pressure of the compressor (high-pressure defrosting).

In the technique described in Patent Literature 3, an outdoor heat exchanger is divided into a plurality of parallel heat exchangers. Then, a part of high-temperature refrigerant discharged from a compressor is reduced in pressure and allowed to alternately flow into the parallel heat exchangers. Thus, by alternately defrosting the parallel heat exchangers, heating can be continuously performed without reversing the refrigeration cycle. The refrigerant supplied to the parallel heat exchanger to be defrosted is injected from an injection port of the compressor.

In this case, the defrosting of the parallel heat exchanger to be defrosted is performed, with the pressure of refrigerant in the parallel heat exchanger being lower than the discharge pressure of the compressor and higher than the suction pressure of the compressor (i.e., the pressure equivalent to a saturation temperature of slightly higher than 0 degrees Celsius) (medium-pressure defrosting).

CITATION LIST

Patent Literature

Patent Literature 1: Japanese Unexamined Patent Application Publication No. 2009-085484 (paragraph [0019], FIG. 3)

Patent Literature 2: Japanese Unexamined Patent Application Publication No. 2008-157558 (paragraph [0007], FIG. 2)

Patent Literature 3: International Publication No. 2012/014345 (paragraph [0006], FIG. 1)

SUMMARY OF INVENTION

Technical Problem

In the low-pressure defrosting operation described in Patent Literature 1, the heat exchanger unit to be defrosted and the heat exchanger unit serving as an evaporator (i.e., the heat exchanger unit not being subjected to defrosting) operate in the same pressure zone. Since the heat exchanger unit serving as an evaporator receives heat from the outdoor air, the evaporating temperature of the refrigerant needs to be lower than the outdoor air temperature.

Accordingly, the saturation temperature of the refrigerant in the heat exchanger unit to be defrosted is lower than the outdoor air temperature. This means that the saturation temperature may be 0 degrees Celsius or below. In this case, the condensation latent heat of the refrigerant cannot be used for melting the frost (0 degrees Celsius), and hence efficient defrosting cannot be achieved.

In the high-pressure defrosting described in Patent Literature 2 and the medium-pressure defrosting described in Patent Literature 3, where the saturation temperature of the refrigerant in the heat exchanger unit to be defrosted is controlled to be higher than 0 degrees Celsius, the condensation latent heat can be used and efficient defrosting can be achieved. However, to increase the pressure in the heat exchanger to be defrosted, a predetermined amount of refrigerant needs to be accumulated in the heat exchanger to be defrosted, before start of defrosting. In conventional techniques, it takes time to accumulate refrigerant in the heat exchanger to be defrosted. As a result, even when a defrosting operation is started, it is not possible to quickly start an efficient defrosting operation.

The present invention has been made to solve the problems described above. An object of the present invention is to provide an air-conditioning apparatus that can quickly start a high-pressure defrosting operation or a medium-pressure defrosting operation for efficiently defrosting an outdoor heat exchanger to be defrosted, without stopping a heating operation of an indoor unit.

Solution to Problem

An air-conditioning apparatus according to the present invention includes a main circuit formed by sequentially connecting, through pipes, a compressor, an indoor heat exchanger, a first flow control valve corresponding to the indoor heat exchanger, a plurality of parallel heat exchangers connected in parallel with each other, and an accumulator to form at least a heating circuit; and a first defrosting pipe configured to allow a part of refrigerant discharged from the compressor to branch off and flow into a selected one of the plurality of parallel heat exchangers. The air-conditioning apparatus is capable of performing a heating-defrosting operation where a specific one of the plurality of parallel heat exchangers is a heat exchanger to be defrosted and serves as a condenser while at least one parallel heat exchanger other than the heat exchanger to be defrosted serves as an evaporator. The air-conditioning apparatus includes a liquid refrigerant transporting unit for transferring liquid refrigerant from the accumulator to the heat exchanger to be defrosted. To perform the heating-defrosting operation, the air-conditioning apparatus supplies, to the heat exchanger to be defrosted, the liquid refrigerant transferred by the liquid refrigerant transporting unit.

Advantageous Effects of Invention

The present invention makes it possible to quickly start a high-pressure defrosting operation or a medium-pressure defrosting operation for efficiently defrosting an outdoor heat exchanger to be defrosted, without stopping a heating operation of an indoor unit.

DESCRIPTION OF EMBODIMENTS

Figure 1:
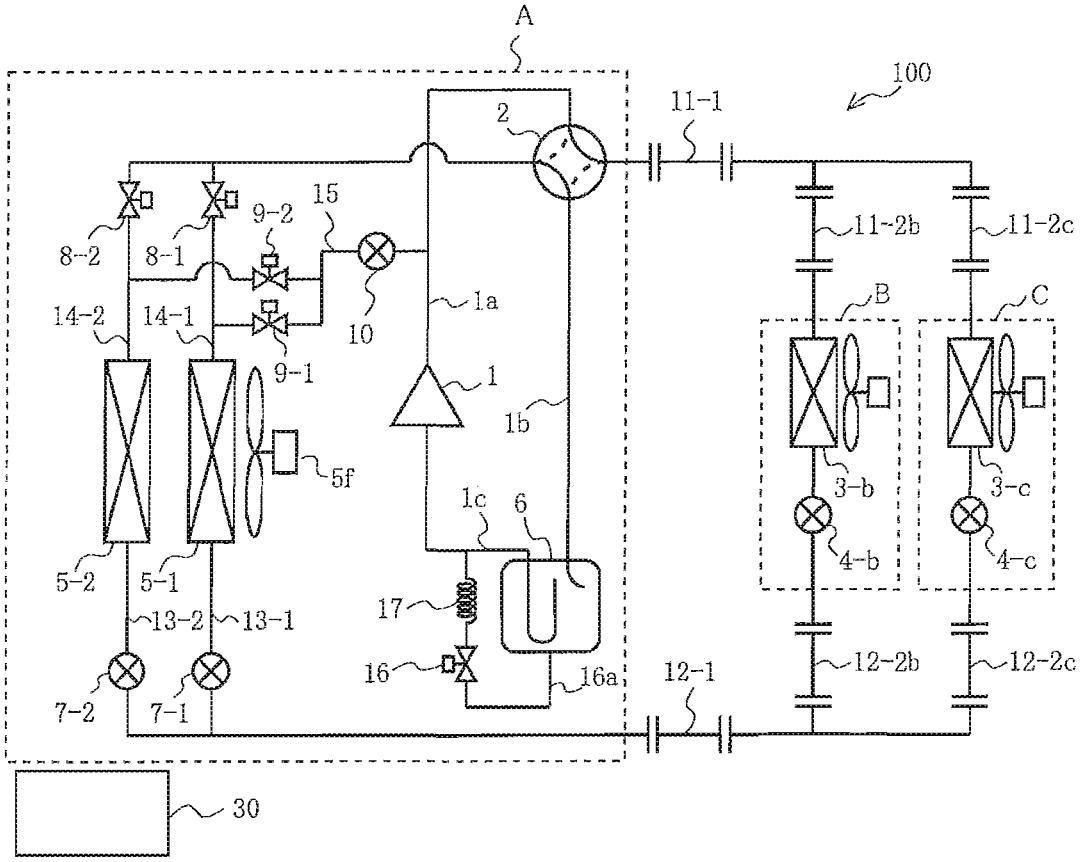
FIG. 1 is a refrigerant circuit diagram illustrating a configuration of a refrigerant circuit of an air-conditioning apparatus 100 according to Embodiment 1 of the present invention.

Embodiments of the present invention will now be described on the basis of the drawings.

Note that components denoted by the same reference numerals in the drawings are the same or corresponding ones, which are common throughout the description.

The configuration of components illustrated throughout the description is merely an example, and the present invention is not limited to the description.

Embodiment 1

FIG. 1 is a refrigerant circuit diagram illustrating a configuration of a refrigerant circuit of an air-conditioning apparatus 100 according to Embodiment 1 of the present invention.

The air-conditioning apparatus 100 includes an outdoor unit A and a plurality of indoor units B and C connected in parallel with each other. The outdoor unit A and the indoor units B and C are connected to each other by first extension pipes 11-1, 11-2*b*, and 11-2*c* and second extension pipes 12-1, 12-2*b*, and 12-2*c*.

The air-conditioning apparatus 100 further includes a controller 30, which controls the cooling operation and the heating operation (normal heating operation, heating-defrosting operation) of the indoor units B and C.

The refrigerant used here is, for example, a fluorocarbon refrigerant, an HFO refrigerant, or a natural refrigerant. Examples of the fluorocarbon refrigerant include R32, R125, and R134a, which are HFC-based refrigerants, and R410A, R407c, and R404A, which are mixtures of the refrigerants described above. Examples of the HFO refrigerant include HFO-1234yf, HFO-1234ze(E), and HFO-1234ze(Z). Refrigerants applicable to vapor compression heat pumps may also be used. Examples of such a refrigerant include a $CO_2$ refrigerant, an HO refrigerant (e.g., propane or isobutene), an ammonia refrigerant, and a mixture of the above-described refrigerants (e.g., a mixture of R32 and HFO-1234yf).

Although Embodiment 1 deals with an example where two indoor units B and C are connected to one outdoor unit A, only one indoor unit may be connected to the outdoor unit A, or three or more outdoor units may be connected in parallel. The refrigerant circuit may be configured to perform a cooling and heating simultaneous operation that allows each of the indoor units to select a cooling or heating operation, for example, by connecting three extension pipes in parallel or providing a switching valve on the indoor unit side.

The configuration of the refrigerant circuit in the air-conditioning apparatus 100 will now be described.

The refrigerant circuit of the air-conditioning apparatus 100 includes a main circuit formed by sequentially connecting, through pipes, a compressor 1, a flow switching device 2 for switching between cooling and heating, indoor heat exchangers 3-*b* and 3-*c*, first flow control devices 4-*b* and 4-*c* that can be opened and closed, and an outdoor heat exchanger 5.

The main circuit further includes an accumulator 6 between suction pipes 1*b* and 1*c* of the compressor.

The flow switching device 2 is connected between a discharge pipe 1*a* and the suction pipe 1*b* of the compressor 1. For example, the flow switching device 2 is formed by a four-way valve that switches the direction of flow of refrigerant.

In the heating operation, the flow switching device 2 is connected in the direction of solid lines in FIG. 1, whereas in the cooling operation, the flow switching device 2 is connected in the direction of dotted lines in FIG. 1.

Figure 2:
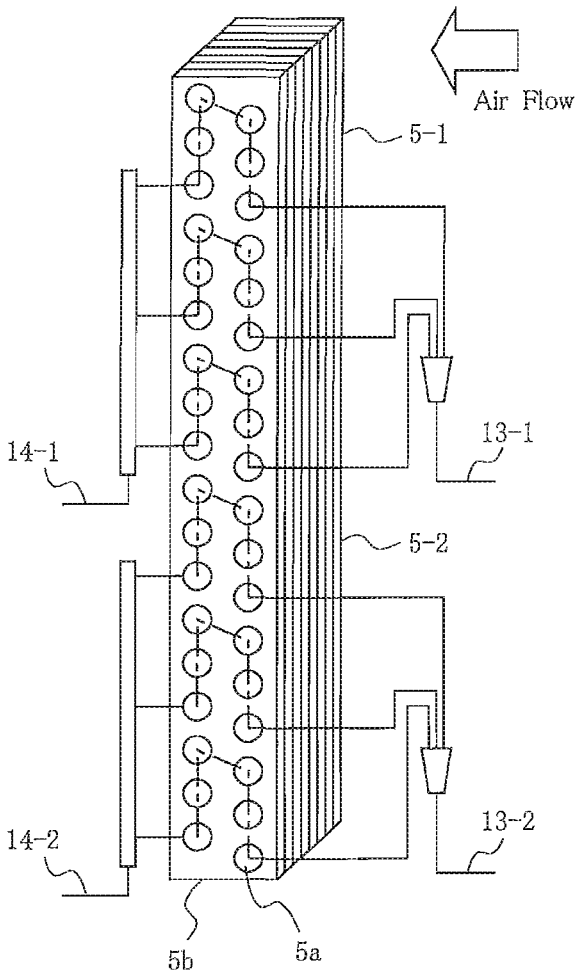
FIG. 2 illustrates a configuration of an outdoor heat exchanger 5 of the air-conditioning apparatus 100 according to Embodiment 1 of the present invention.

FIG. 2 illustrates a configuration of the outdoor heat exchanger 5 of the air-conditioning apparatus 100 according to Embodiment 1 of the present invention.

As illustrated in FIG. 2, the outdoor heat exchanger 5 is formed, for example, by a fin-tube heat exchanger including a plurality of heat transfer tubes 5*a* and a plurality of fins 5*b*. The outdoor heat exchanger 5 is divided into a plurality of parallel heat exchangers. In the example, the outdoor heat exchanger 5 is divided into two parallel heat exchangers 5-1 and 5-2.

The heat transfer tubes 5*a*, which allow passage of the refrigerant therein, are arranged in a column direction perpendicular to the direction of air passage and in a row direction, which is the direction of air passage.

The fins 5*b* are spaced apart to allow air to pass in the direction of air passage.

The parallel heat exchangers 5-1 and 5-2 are formed by dividing the outdoor heat exchanger 5 inside the housing of the outdoor unit A. The outdoor heat exchanger 5 may be divided into right and left parts. In this case, however, the refrigerant inlets of the parallel heat exchangers 5-1 and 5-2 are located at both right and left ends of the outdoor unit A. Since this makes the pipe connection complex, it is preferable to divide the outdoor heat exchanger 5 into upper and lower parts, as illustrated in FIG. 2.

The fins 5*b* of the parallel heat exchangers 5-1 and 5-2 may be divided, or may not be divided as in FIG. 2. The outdoor heat exchanger 5 does not necessarily need to be divided into two, but may be divided into any number of parallel heat exchangers.

Outdoor air is conveyed to the parallel heat exchangers 5-1 and 5-2 by an outdoor fan 5*f*.

The outdoor fan 5*f* may be provided for each of the parallel heat exchangers 5-1 and 5-2, but a single fan may be shared as illustrated in FIG. 1.

First connection pipes 13-1 and 13-2 are connected to the parallel heat exchangers 5-1 and 5-2, respectively, on the side of the parallel heat exchangers 5-1 and 5-2 connected to the first flow control devices 4-*b* and 4*c*.

The first connection pipes 13-1 and 13-2, which are connected in parallel with a main pipe, are provided with second flow control devices 7-1 and 7-2, respectively.

The second flow control devices 7-1 and 7-2 are each a valve capable of varying the opening degree thereof in accordance with an instruction from the controller 30. The second flow control devices 7-1 and 7-2 are each formed, for example, by an electronically controlled expansion valve.

The second flow control devices 7-1 and 7-2 according to Embodiment 1 correspond to "fourth expansion device" of the present invention.

Second connection pipes 14-1 and 14-2 are connected to the parallel heat exchangers 5-1 and 5-2, respectively, on the side of the parallel heat exchangers 5-1 and 5-2 connected to the compressor 1. At the same time, the second connection pipes 14-1 and 14-2 are connected through first solenoid valves 8-1 and 8-2, respectively, to the compressor 1.

The refrigerant circuit further includes a first defrosting pipe 15 for supplying a part of high-temperature and high-pressure refrigerant discharged from the compressor 1 to the parallel heat exchanges 5-1 and 5-2 for the defrosting operation.

The first defrosting pipe 15 is connected at one end thereof to the discharge pipe 1*a* and is divided at the other end thereof into branches, which are connected to the respective second connection pipes 14-1 and 14-2.

The first defrosting pipe 15 is provided with an expansion device 10, which reduces the pressure of a part of high-temperature and high-pressure refrigerant discharged from the compressor 1 to a medium level before the refrigerant is supplied to the parallel heat exchangers 5-1 and 5-2. The branches of the first defrosting pipe 15 are provided with respective second solenoid valves 9-1 and 9-2.

Figure 3:
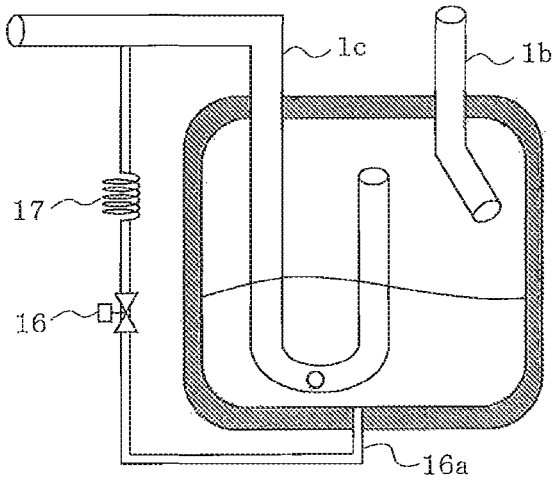
FIG. 3 illustrates a configuration of an accumulator 6 of the air-conditioning apparatus 100 according to Embodiment 1 of the present invention.
Figure 4:
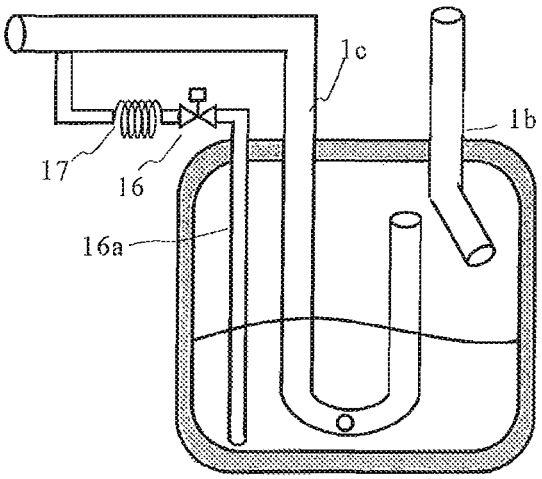
FIG. 4 illustrates another configuration of the accumulator 6 of the air-conditioning apparatus 100 according to Embodiment 1 of the present invention.
Figure 5:
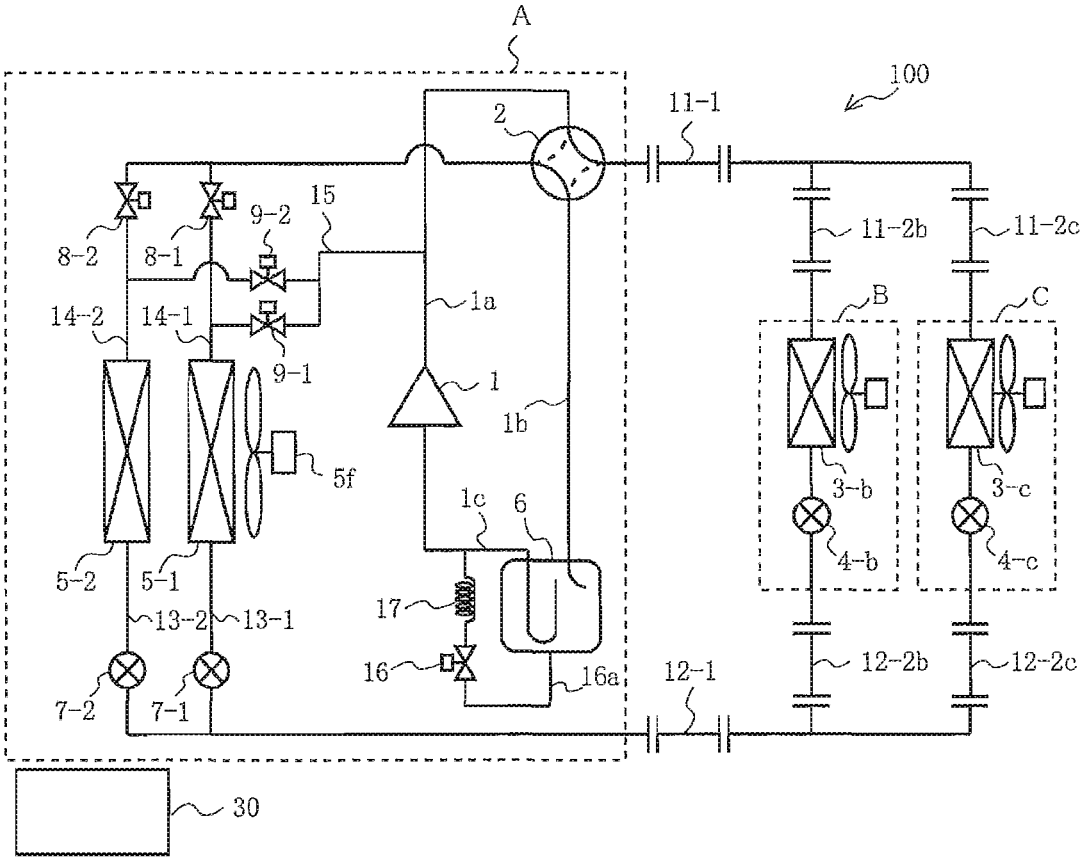
FIG. 5 is a refrigerant circuit diagram illustrating a configuration of a refrigerant circuit of the air-conditioning apparatus 100 according to Embodiment 1 of the present invention.

FIG. 3 illustrates a configuration of the accumulator 6 of the air-conditioning apparatus 100 according to Embodiment 1 of the present invention. FIG. 4 illustrates another configuration of the accumulator 6 of the air-conditioning apparatus 100 according to Embodiment 1 of the present invention. FIG. 5 is a refrigerant circuit diagram illustrating a configuration of the refrigerant circuit of the air-conditioning apparatus 100 according to Embodiment 1 of the present invention.

When refrigerant from the suction pipe 1*b* contains liquid, the accumulator 6 separates the refrigerant liquid to allow only a refrigerant gas component to flow out of the end of a U-shaped portion of the suction pipe 1*c*. The bottom of the U-shaped portion has a hole that connects the interior of the accumulator to the suction pipe 1*c*. This is an oil return hole for returning oil that circulates in the refrigerant circuit to the compressor.

A first bypass pipe 16*a* is connected at one end thereof to the bottom of the accumulator 6, and connected at the other end thereof to the suction pipe 1*c* of the compressor. The first bypass pipe 16*a* is provided with a solenoid valve 16 and an expansion device 17. When the solenoid valve 16 is opened, a first liquid refrigerant transporting circuit is opened, which is formed by sequentially connecting the accumulator 6, the first bypass pipe 16*a*, the solenoid valve 16, the expansion device 17, and the suction pipe 1*c*. This allows a part of liquid refrigerant accumulated in the accumulator 6 to return to the suction pipe 1*c* of the compressor 1.

When the first bypass pipe 16*a* is attached to the bottom of the accumulator 6, the structure of a supporting base that supports the accumulator 6 may be complex. To simplify the structure of the supporting base, the first bypass pipe 16*a* may be inserted through the upper part of the accumulator as illustrated in FIG. 4. The expansion device 10 may be omitted as illustrated in FIG. 5. This enables a high-pressure defrosting operation where the pressure in the parallel heat exchangers 5-1 and 5-2 to be defrosted is equal to the discharge pressure of the compressor. As will be described, however, the amount of refrigerant required for the defrosting operation increases as the pressure in the parallel heat exchangers 5-1 and 5-2 to be defrosted increases. In medium-pressure defrosting that involves using the expansion device 10, the pressure in the parallel heat exchangers 5-1 and 5-2 to be defrosted is reduced, and the amount of refrigerant required for the defrosting operation is reduced. This allows an efficient defrosting operation to be started in a shorter time.

The first solenoid valves 8-1 and 8-2 and the second solenoid valves 9-1 and 9-2 may be four-way valves, three-way valves, or two-way valves, as long as they are capable of switching the flow passage. If a required defrosting capacity, or a refrigerant flow rate for defrosting, is determined, a capillary tube may be used as the expansion device 10. The expansion device 10 may be removed and then, to reduce the pressure to a medium level at a predetermined defrosting flow rate, the second solenoid valves 9-1 and 9-2 may be reduced in size to add a pressure loss to the refrigerant flowing through the solenoid valves. The expansion device 10 may be removed, and the second solenoid valves 9-1 and 9-2 may be replaced by flow control devices.

The solenoid valve 16 may be reduced in size to add a pressure loss to the refrigerant flowing through the solenoid valve, and then the expansion device 17 may be removed.

The expansion device 10 corresponds to "third expansion device" of the present invention, and the solenoid valve 16 and the expansion device 17 corresponds to "first expansion device" of the present invention.

Various operations performed by the air-conditioning apparatus 100 will now be described.

The air-conditioning apparatus 100 provides two operation modes, a cooling operation and a heating operation. The heating operation includes a normal heating operation in which the parallel heat exchangers 5-1 and 5-2 forming the outdoor heat exchanger 5 both serve as a normal evaporator, and a heating-defrosting operation (also referred to as a continuous heating operation).

The heating-defrosting operation involves alternately defrosting the parallel heat exchangers 5-1 and 5-2 while maintaining the heating operation. That is, one of the parallel heat exchangers is defrosted while the other of the parallel heat exchangers serves as an evaporator to maintain the heating operation. Then, when the defrosting of the one of the parallel heat exchangers ends, the one of the parallel heat exchangers serves in turn as an evaporator to maintain the heating operation while the other of the parallel heat exchangers is defrosted.

The following Table 1 shows the ON/OFF state and the opening degree control for each valve in the operations of the air-conditioning apparatus 100 illustrated in FIG. 1.

In the table, "ON" for the flow switching device 2 indicates that the four-way valve is connected in the direction of solid lines in FIG. 1, and "OFF" for the flow switching device 2 indicates that the four-way valve is connected in the direction of dotted lines in FIG. 1. Also, "ON" for the solenoid valves 8-1, 8-2, 9-1, 9-2, and 16 indicates that the solenoid valve is open to allow the refrigerant to flow, and "OFF" for the solenoid valves 8-1, 8-2, 9-1, 9-2, and 16 indicates that the solenoid valve is closed.

TABLE 1

| | | HEATING | | |
|---|---|---|---|---|
| | | | CONTINUOUS HEATING | |
| VALVE NUMBER | COOLING | NORMAL OPERATION | 5-1: EVAPORATOR 5-2: DEFROSTING | 5-1: DEFROSTING 5-2: EVAPORATOR |
| 2 | OFF | ON | ON | ON |
| 4-b, 4-c | REFRIGERANT SUPERHEAT AT OUTLET OF INDOOR UNIT | REFRIGERANT SUBCOOLING AT OUTLET OF INDOOR UNIT | REFRIGERANT SUBCOOLING AT OUTLET OF INDOOR UNIT | REFRIGERANT SUBCOOLING AT OUTLET OF INDOOR UNIT |
| 7-1 | FULL OPEN | FULL OPEN | PRESSURE IN HEAT EXCHANGER TO BE DEFROSTED | FULL OPEN |
| 7-2 | FULL OPEN | FULL OPEN | FULL OPEN | PRESSURE IN HEAT EXCHANGER TO BE DEFROSTED |
| 8-1 | ON | ON | OFF | ON |
| 8-2 | ON | ON | ON | OFF |

TABLE 1-continued

| | | HEATING | | |
|---|---|---|---|---|
| | | | CONTINUOUS HEATING | |
| VALVE NUMBER | COOLING | NORMAL OPERATION | 5-1: EVAPORATOR 5-2: DEFROSTING | 5-1: DEFROSTING 5-2: EVAPORATOR |
| 9-1 | OFF | OFF | ON | OFF |
| 9-2 | OFF | OFF | OFF | ON |
| 10 | CLOSED | CLOSED | FIXED OPENING DEGREE | FIXED OPENING DEGREE |
| 16 | OFF | OFF | ON | ON |

[Cooling Operation]

Figure 6:
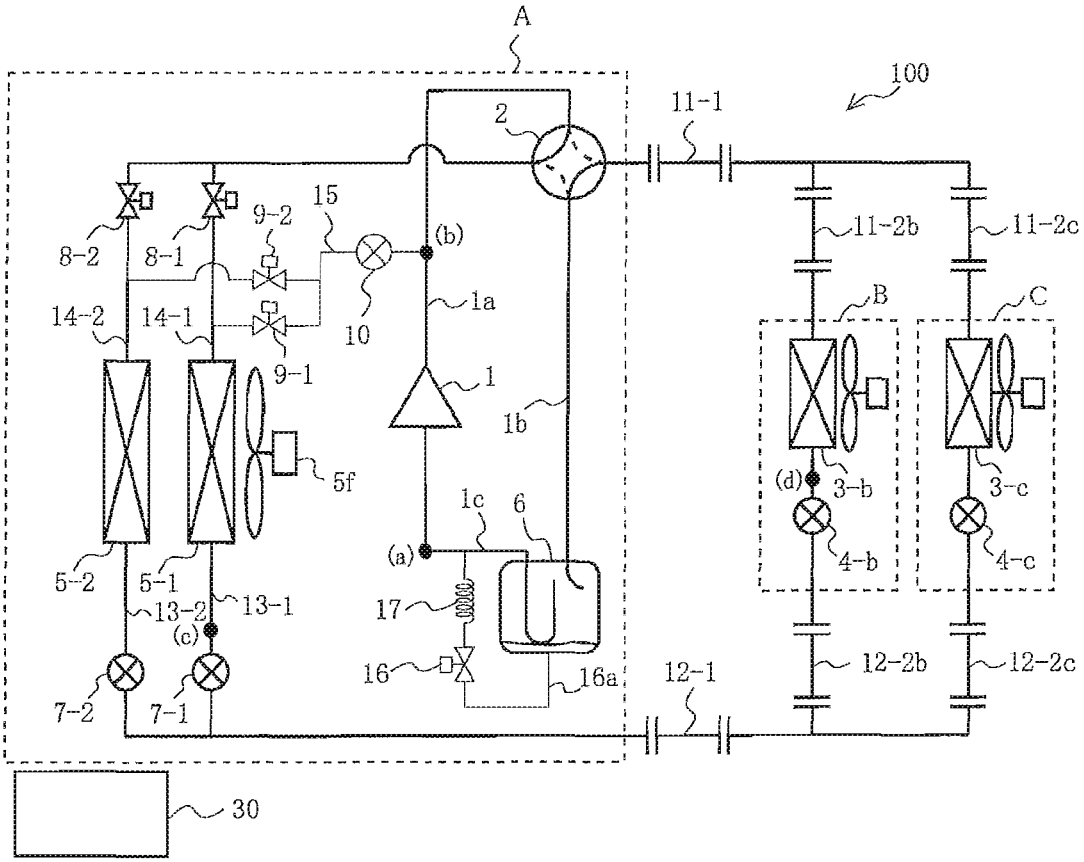
FIG. 6 illustrates a flow of refrigerant during cooling operation of the air-conditioning apparatus 100 according to Embodiment 1 of the present invention.

FIG. 6 illustrates a flow of refrigerant during cooling operation of the air-conditioning apparatus 100 according to Embodiment 1 of the present invention. In FIG. 6, a thick line represents a portion through which the refrigerant flows during cooling operation, and a thin line represents a portion through which the refrigerant does not flow during cooling operation.

Figure 7:
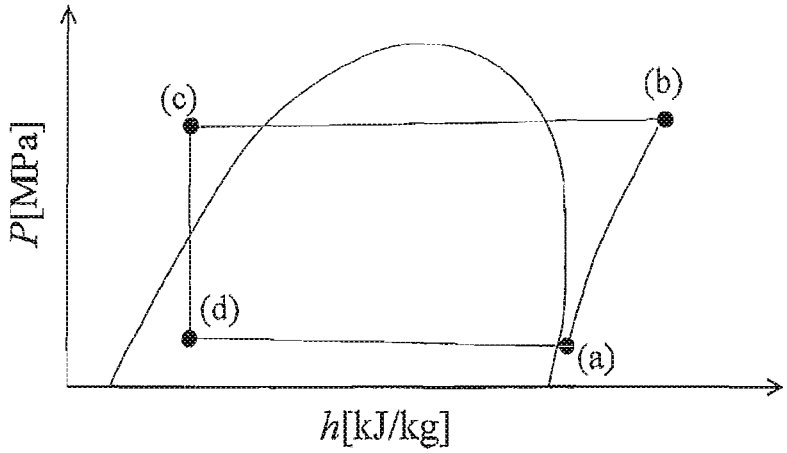
FIG. 7 is a P-h diagram of a cooling operation in the air-conditioning apparatus 100 according to Embodiment 1 of the present invention.

FIG. 7 is a P-h diagram of a cooling operation in the air-conditioning apparatus 100 according to Embodiment 1 of the present invention. Points (a) to (d) in FIG. 7 each indicate the state of refrigerant at the position indicated by the same character in FIG. 6.

When the compressor 1 starts to operate, low-temperature and low-pressure gas refrigerant is compressed by the compressor 1 and discharged therefrom as high-temperature and high-pressure gas refrigerant.

In the refrigerant compression process of the compressor 1, the refrigerant is compressed to be hotter than in the case of adiabatic compression along an isentrope, by the extent of adiabatic efficiency of the compressor 1, as indicated by a line extending from point (a) to point (b) in FIG. 7.

The high-temperature and high-pressure gas refrigerant discharged from the compressor 1 passes through the flow switching device 2 and is divided into two streams, one of which passes through the first solenoid valve 8-1 and the second connection pipe 14-1 and flows into the parallel heat exchanger 5-1. The other of the two streams passes through the first solenoid valve 8-2 and the second connection pipe 14-2 and flows into the parallel heat exchanger 5-2.

The refrigerant flowing into the parallel heat exchangers 5-1 and 5-2 is cooled while heating the outdoor air, and turns into medium-temperature and high-pressure liquid refrigerant. When pressure loss in the outdoor heat exchanger 5 is taken into account, the transition of the refrigerant in the parallel heat exchangers 5-1 and 5-2 is represented by a slightly inclined, substantially horizontal straight line extending from point (b) to point (c) in FIG. 7.

For example, when the operation capacity of the indoor units B and C is small, the first solenoid valve 8-2 may be closed to stop the refrigerant from flowing into the parallel heat exchanger 5-2, thereby eventually reducing the heat transfer area of the outdoor heat exchanger 5 to stabilize the operation of the cycle.

Streams of medium-temperature and high-pressure liquid refrigerant flowing out of the parallel heat exchangers 5-1 and 5-2 flow into the first connection pipes 13-1 and 13-2 and join together after passing through the second flow control devices 7-1 and 7-2 that are fully open. The resulting refrigerant passes through the second extension pipes 12-1, 12-2*b*, and 12-2*c* and flows into the first flow control devices 4-*b* and 4-*c*, where it is throttled, expanded, reduced in pressure, and then turns into low-temperature and low-pressure two-phase gas-liquid refrigerant. The transition of the refrigerant in the first flow control devices 4-*b* and 4-*c* takes place under constant enthalpy, and can be represented by a vertical line extending from point (c) to point (d) in FIG. 7.

The low-temperature and low-pressure two-phase gas-liquid refrigerant flowing out of the first flow control devices 4-*b* and 4-*c* flows into the indoor heat exchangers 3-*b* and 3-*c*. After flowing into the indoor heat exchangers 3-*b* and 3-*c*, the refrigerant is heated while cooling the indoor air, and turns into low-temperature and low-pressure gas refrigerant. Note that the first flow control devices 4-*b* and 4-*c* are controlled such that the degree of superheat of the low-temperature and low-pressure gas refrigerant is about 2 K to 5 K.

When pressure loss is taken into account, the transition of the refrigerant in the indoor heat exchangers 3-*b* and 3-*c* is represented by a slightly inclined, substantially horizontal straight line extending from point (d) to point (a) in FIG. 7. After flowing out of the indoor heat exchangers 3-*b* and 3-*c*, the low-temperature and low-pressure gas refrigerant passes through the first extension pipes 11-2*b*, 11-2*c*, and 11-1, the flow switching device 2, and the accumulator 6, and flows into the compressor 1 and is compressed therein.

When the first flow control devices 4-*b* and 4-*c* operate such that superheat is generated in the indoor heat exchangers 3-*b* and 3-*c*, no liquid refrigerant is present in the accumulator 6 and, as illustrated in FIG. 6, only a part of oil circulating in the refrigerant circuit collects at the bottom lower than the oil return hole in the U-shaped portion. The solenoid valve 16 may be opened to drain the oil collecting at the bottom of the accumulator 6. If the degree of subcooling of the medium-temperature and high-pressure liquid refrigerant flowing out of the parallel heat exchangers 5-1 and 5-2 is determined to be large, the opening degree of the first flow control devices 4-*b* and 4-*c* may be set to be large so that the liquid is accumulated in the accumulator 6.

[Normal Heating Operation]

Figure 8:
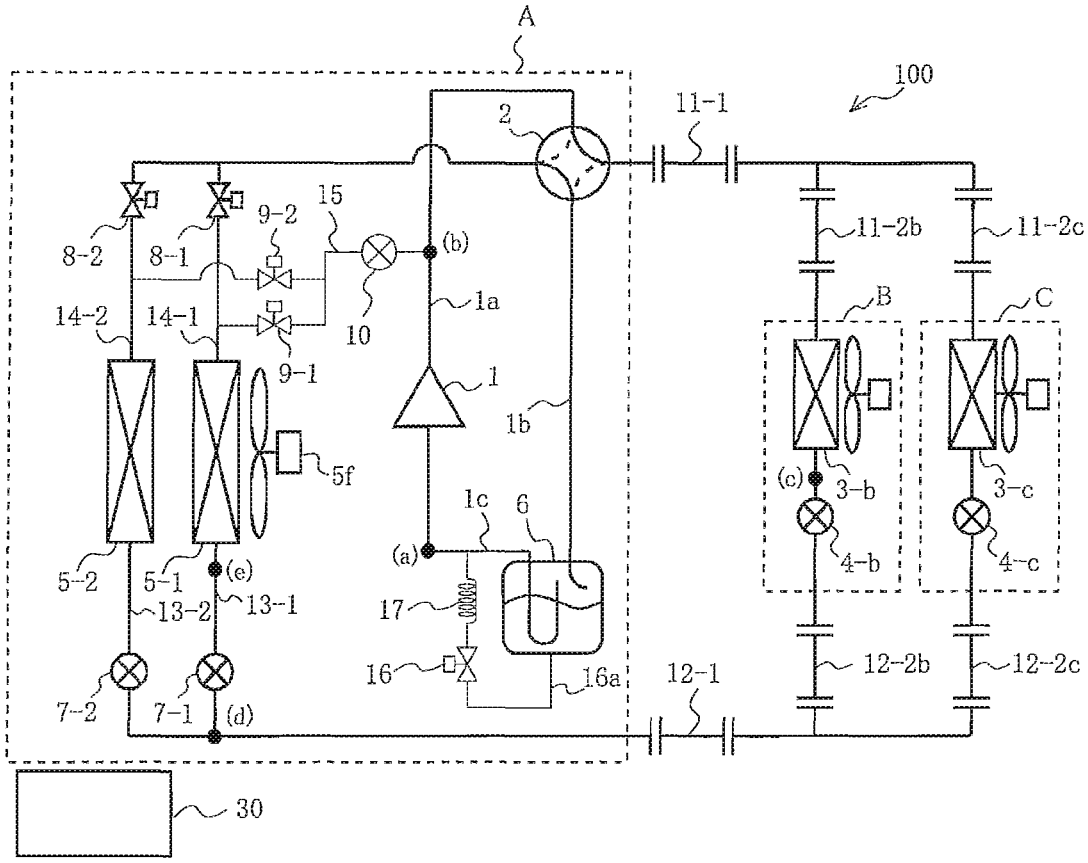
FIG. 8 illustrates a flow of refrigerant during normal heating operation of the air-conditioning apparatus 100 according to Embodiment 1 of the present invention.

FIG. 8 illustrates a flow of refrigerant during normal heating operation of the air-conditioning apparatus 100 according to Embodiment 1 of the present invention. In FIG. 8, a thick line represents a portion through which the refrigerant flows during normal heating operation, and a thin line represents a portion through which the refrigerant does not flow during normal heating operation.

Figure 9:
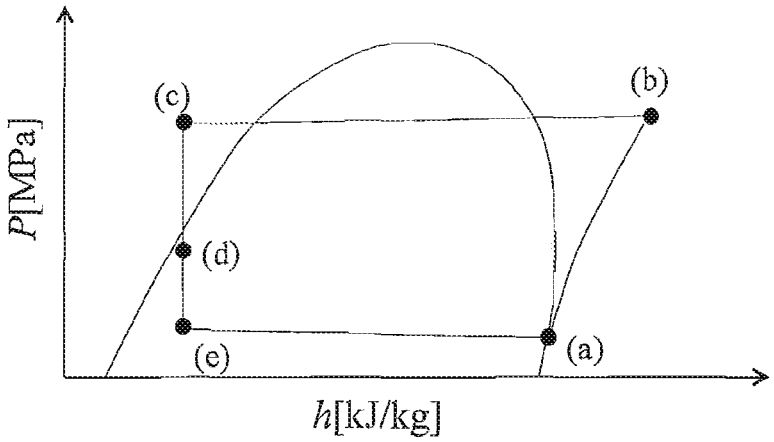
FIG. 9 is a P-h diagram of a normal heating operation in the air-conditioning apparatus 100 according to Embodiment 1 of the present invention.

FIG. 9 is a P-h diagram of a normal heating operation in the air-conditioning apparatus 100 according to Embodiment 1 of the present invention. Points (a) to (e) in FIG. 9 each indicate the state of refrigerant at the position indicated by the same character in FIG. 8.

When the compressor 1 starts to operate, low-temperature and low-pressure gas refrigerant is compressed by the compressor 1 and discharged therefrom as high-temperature and high-pressure gas refrigerant. This refrigerant compression process of the compressor 1 is indicated by a line extending from point (a) to point (b) in FIG. 9.

The high-temperature and high-pressure gas refrigerant discharged from the compressor 1 passes through the flow switching device 2 and flows out of the outdoor unit A. The high-temperature and high-pressure gas refrigerant flowing out of the outdoor unit A passes through the first extension pipes 11-1, 11-2*b*, and 11-2*c*, and flows into the indoor heat exchangers 3-*b* and 3-*c* in the indoor units B and C.

The refrigerant flowing into the indoor heat exchangers 3-*b* and 3-*c* is cooled while heating the indoor air, and turns into medium-temperature and high-pressure liquid refrigerant. The transition of the refrigerant in the indoor heat exchangers 3-*b* and 3-*c* is represented by a slightly inclined, substantially horizontal straight line extending from point (b) to point (c) in FIG. 9.

The medium-temperature and high-pressure liquid refrigerant flowing out of the indoor heat exchangers 3-*b* and 3-*c* flows into the first flow control devices 4-*b* and 4-*c*, where it is throttled, expanded, reduced in pressure, and then turns into medium-pressure two-phase gas-liquid refrigerant.

This transition of the refrigerant is represented by a vertical line extending from point (c) to point (d) in FIG. 9.

Note that the first flow control devices 4-*b* and 4-*c* are controlled such that the degree of subcooling of the medium-temperature and high-pressure liquid refrigerant is about 5 K to 20 K.

The medium-pressure two-phase gas-liquid refrigerant flowing out of the first flow control devices 4-*b* and 4-*c* passes through the second extension pipes 12-2*b*, 12-2*c*, and 12-1 and returns to the outdoor unit A. After returning to the outdoor unit A, the refrigerant flows into the first connection pipes 13-1 and 13-2.

The refrigerant flowing into the first connection pipes 13-1 and 13-2 is throttled, expanded, and reduced in pressure by the second flow control devices 7-1 and 7-2 and turns into low-pressure two-phase gas-liquid refrigerant. This transition of the refrigerant is represented by a line extending from point (d) to point (e) in FIG. 9.

Note that the second flow control devices 7-1 and 7-2 are fixed at a given opening degree (e.g., in a fully opened state), or controlled such that the saturation temperature at the intermediate pressure, for example, in the second extension pipe 12-1 is about 0 degrees Celsius to 20 degrees Celsius.

After flowing out of the second flow control devices 7-1 and 7-2, the refrigerant flows into the parallel heat exchangers 5-1 and 5-2 and is heated while cooling the outdoor air, thereby turning into low-temperature and low-pressure gas refrigerant. This transition of the refrigerant in the parallel heat exchangers 5-1 and 5-2 is represented by a slightly inclined, substantially horizontal straight line extending from point (e) to point (a) in FIG. 9.

Streams of low-temperature and low-pressure gas refrigerant flowing out of the parallel heat exchangers 5-1 and 5-2 flow into the second connection pipes 14-1 and 14-2 and join together after passing through the first solenoid valves 8-1 and 8-2. The resulting refrigerant passes through the flow switching device 2 and the accumulator 6, flows into the compressor 1, and is compressed therein.

In the heating operation, pipes through which high-density refrigerant flows are only the outlet pipes of the indoor heat exchangers 3-*b* and 3-*c*. Hence, excess refrigerant is generated, and liquid refrigerant is accumulated in the accumulator 6 as illustrated in FIG. 8.

[Heating-Defrosting Operation (Continuous Heating Operation)]

A heating-defrosting operation is performed when frost forms on the outdoor heat exchanger 5 during normal heating operation.

Frost is determined to have formed if, for example, the saturation temperature converted from the suction pressure of the compressor 1 drops significantly below a predetermined outdoor air temperature. Alternatively, frost may be determined to have formed if, for example, a certain period of time elapses after the difference between the outdoor air temperature and the evaporating temperature becomes greater than or equal to a predetermined value.

In the configuration of the air-conditioning apparatus 100 according to Embodiment 1, in the heating-defrosting operation, the parallel heat exchanger 5-2 may be defrosted while the parallel heat exchanger 5-1 serves as an evaporator to maintain the heating operation. Conversely, the parallel heat exchanger 5-2 may serve as an evaporator to maintain the heating operation while the parallel heat exchanger 5-1 is defrosted.

These operations are performed in the same manner, except that the open/close state of the solenoid valves 8-1, 8-2, 9-1, and 9-2 in one operation is opposite to that in the other, and that the flow of refrigerant is switched between the parallel heat exchangers 5-1 and 5-2. The following description deals with an example where the parallel heat exchanger 5-2 is defrosted while the parallel heat exchanger 5-1 serves as an evaporator to maintain the heating operation. The same applies to the other Embodiments described below.

Figure 10:
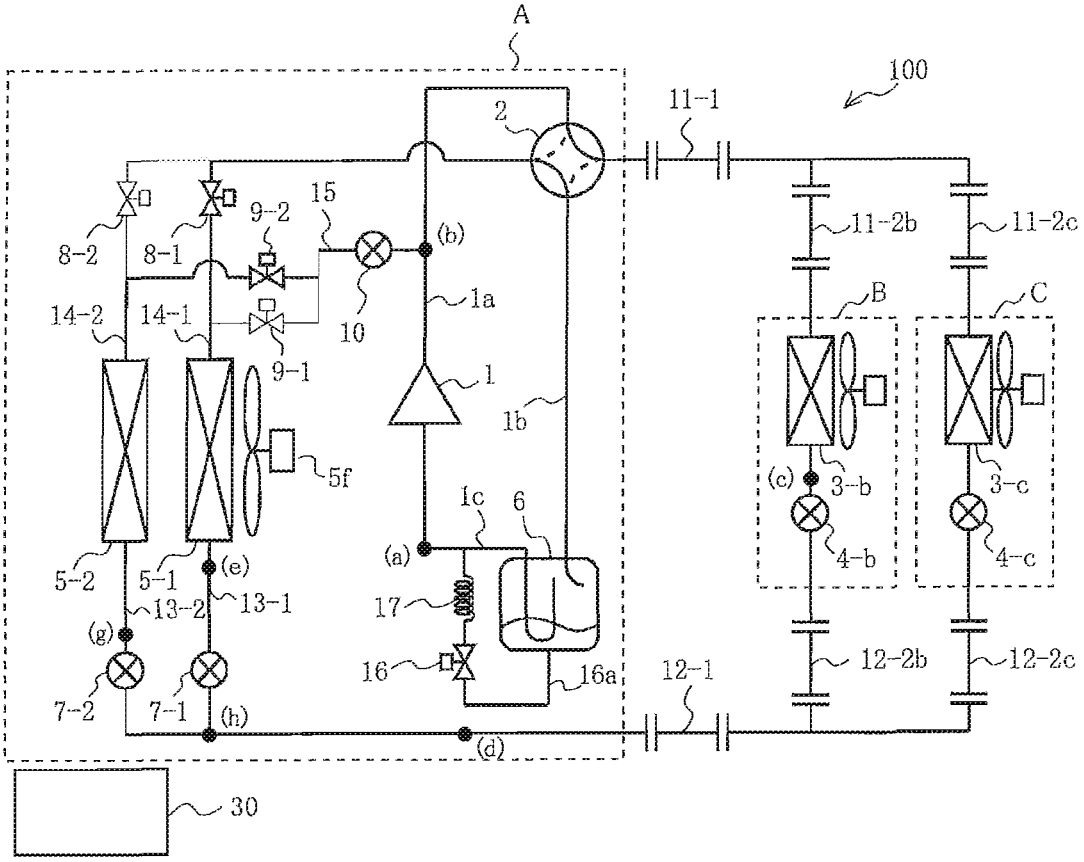
FIG. 10 illustrates a flow of refrigerant during heating-defrosting operation of the air-conditioning apparatus 100 according to Embodiment 1 of the present invention.

FIG. 10 illustrates a flow of refrigerant during heating-defrosting operation of the air-conditioning apparatus 100 according to Embodiment 1 of the present invention. In FIG. 10, a thick line represents a portion through which the refrigerant flows during heating-defrosting operation, and a thin line represents a portion through which the refrigerant does not flow during heating-defrosting operation.

Figure 11:
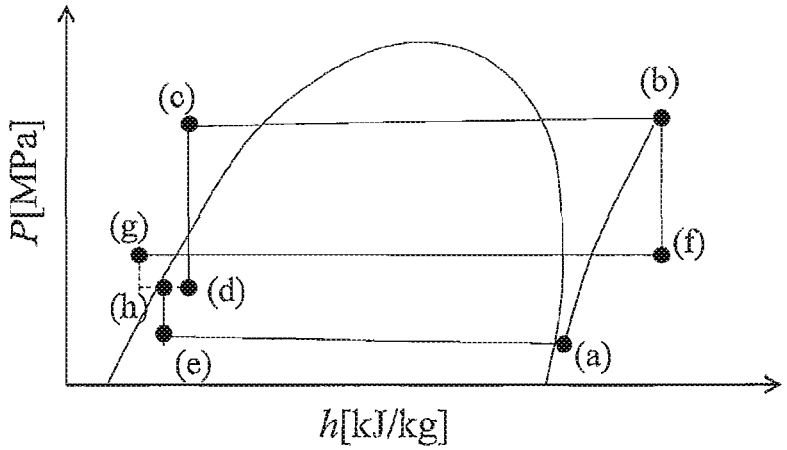
FIG. 11 is a P-h diagram of a heating-defrosting operation in the air-conditioning apparatus 100 according to Embodiment 1 of the present invention.

FIG. 11 is a P-h diagram of a heating-defrosting operation in the air-conditioning apparatus 100 according to Embodiment 1 of the present invention. Points (a) to (h) in FIG. 11 each indicate the state of refrigerant at the position indicated by the same character in FIG. 10.

Upon detecting that defrosting is required for removal of frost during normal heating operation, the controller 30 closes the first solenoid valve 8-2 corresponding to the parallel heat exchanger 5-2 to be defrosted. Then, the controller 30 opens the second solenoid valve 9-2, and opens the expansion device 10 to a predetermined opening degree.

This opens a medium-pressure defrosting circuit formed by sequentially connecting the compressor 1, the expansion device 10, the second solenoid valve 9-2, the parallel heat exchanger 5-2, the second flow control device 7-2, and the second flow control device 7-1, thereby starting the heating-defrosting operation.

When the heating-defrosting operation is started, a part of high-temperature and high-pressure gas refrigerant discharged from the compressor 1 flows into the first defrosting pipe 15 and is reduced in pressure to a medium level by the expansion device 10. This transition of the refrigerant is represented by a line extending from point (b) to point (f) in FIG. 11.

After being reduced in pressure to the medium level (point (f)), the refrigerant passes through the second solenoid valve 9-2 and flows into the parallel heat exchanger 5-2. The refrigerant in the parallel heat exchanger 5-2 is cooled by exchanging heat with the frost on the parallel heat exchanger 5-2.

Thus, the frost on the parallel heat exchanger 5-2 can be melted by allowing the high-temperature and high-pressure gas refrigerant discharged from the compressor 1 to flow into the parallel heat exchanger 5-2. This transition of the refrigerant is represented by a line extending from point (f) to point (g) in FIG. 11.

The refrigerant used for defrosting has a saturation temperature of about 0 degrees Celsius to 10 degrees Celsius, which is higher than or equal to the temperature of frost (0 degrees Celsius), as described below.

After being used for defrosting, the refrigerant passes through the second flow control device 7-2 and reaches point (h), where it meets the main circuit. The refrigerant then flows into the parallel heat exchanger 5-1 serving as an evaporator, and evaporates therein.

Reasons for which the saturation temperature of the refrigerant used for defrosting is set higher than 0 degrees Celsius and lower than or equal to 10 degrees Celsius will be described with reference to FIGS. 12 to 16.

Figure 12:
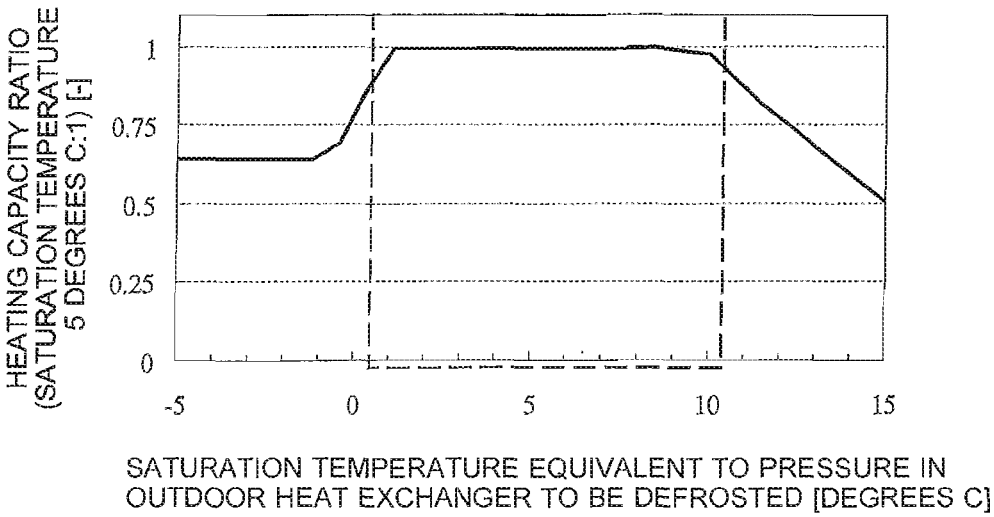
FIG. 12 is a graph showing the ratio of heating capacity with respect to pressure (converted to saturated liquid temperature) in an outdoor heat exchanger to be defrosted in the air-conditioning apparatus 100 according to Embodiment 1 of the present invention.

FIG. 12 is a graph showing a heating capacity calculated by varying the pressure (converted to saturated liquid temperature in the drawing) in the outdoor heat exchanger 5 to be defrosted while the defrosting capacity is fixed, in the air-conditioning apparatus using an R410A refrigerant.

Figure 13:
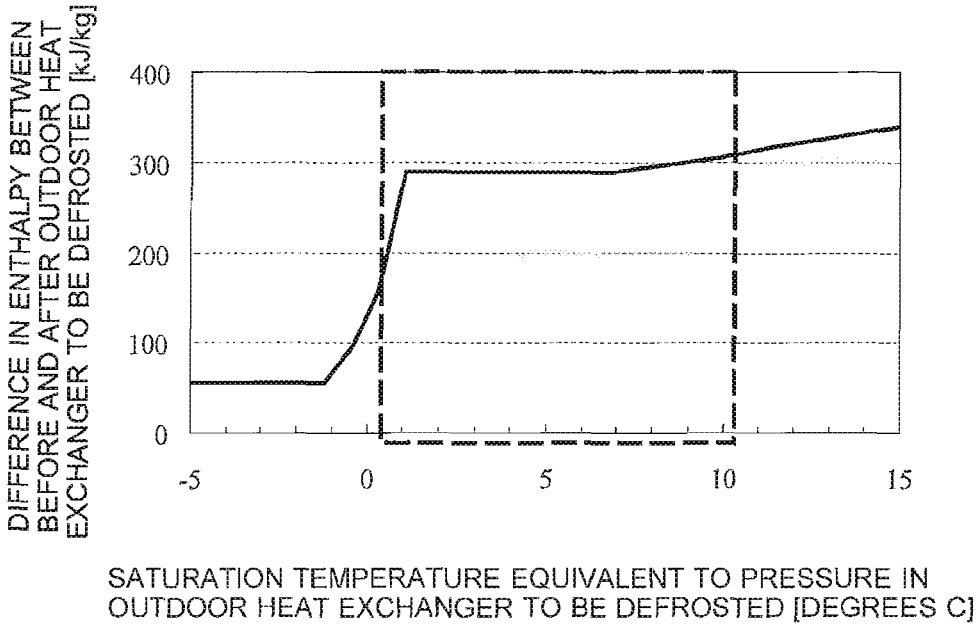
FIG. 13 is a graph showing a difference in enthalpy between before and after the outdoor heat exchanger to be defrosted, with respect to pressure (converted to saturated liquid temperature) in the outdoor heat exchanger to be defrosted in the air-conditioning apparatus 100 according to Embodiment 1 of the present invention.

FIG. 13 is a graph showing a difference in enthalpy between before and after the outdoor heat exchanger 5 to be defrosted, the difference being calculated by varying the pressure (converted to saturated liquid temperature in the drawing) in the outdoor heat exchanger 5 to be defrosted while the defrosting capacity is fixed, in the air-conditioning apparatus using an R410A refrigerant.

Figure 14:
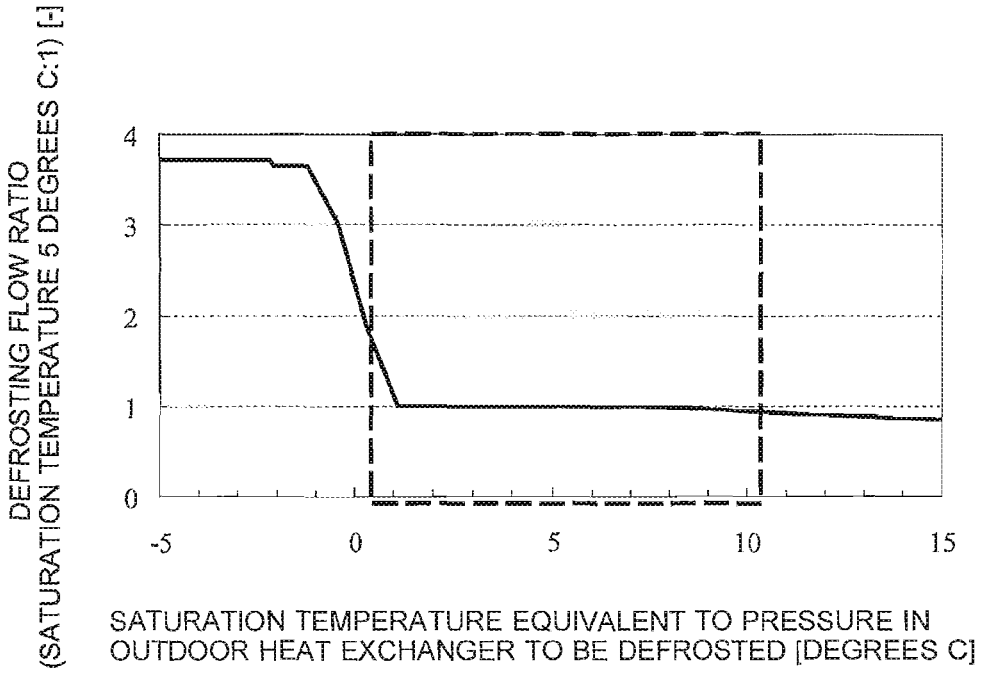
FIG. 14 is a graph showing a defrosting flow ratio with respect to pressure (converted to saturated liquid temperature) in the outdoor heat exchanger to be defrosted in the air-conditioning apparatus 100 according to Embodiment 1 of the present invention.

FIG. 14 is a graph showing a flow rate required for defrosting, the flow rate being calculated by varying the pressure (converted to saturated liquid temperature in the drawing) in the outdoor heat exchanger 5 to be defrosted while the defrosting capacity is fixed, in the air-conditioning apparatus using an R410A refrigerant.

Figure 15:
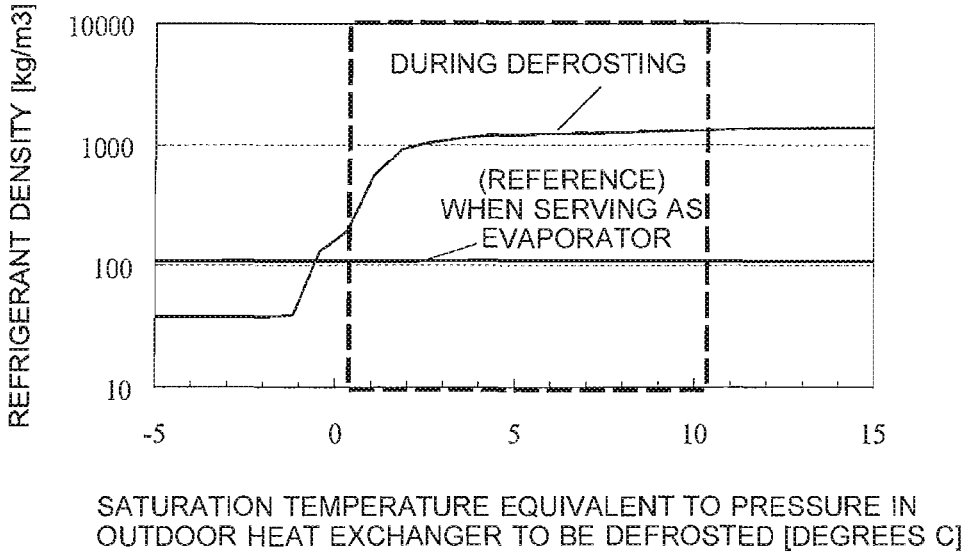
FIG. 15 is a graph showing the amount of refrigerant with respect to pressure (converted to saturated liquid temperature) in the outdoor heat exchanger to be defrosted in the air-conditioning apparatus 100 according to Embodiment 1 of the present invention.

FIG. 15 is a graph showing a density in the accumulator 6 and the outdoor heat exchanger 5 to be defrosted, the density being calculated by varying the pressure (converted to saturated liquid temperature in the drawing) in the outdoor heat exchanger 5 to be defrosted while the defrosting capacity is fixed, in the air-conditioning apparatus using an R410A refrigerant.

Figure 16:
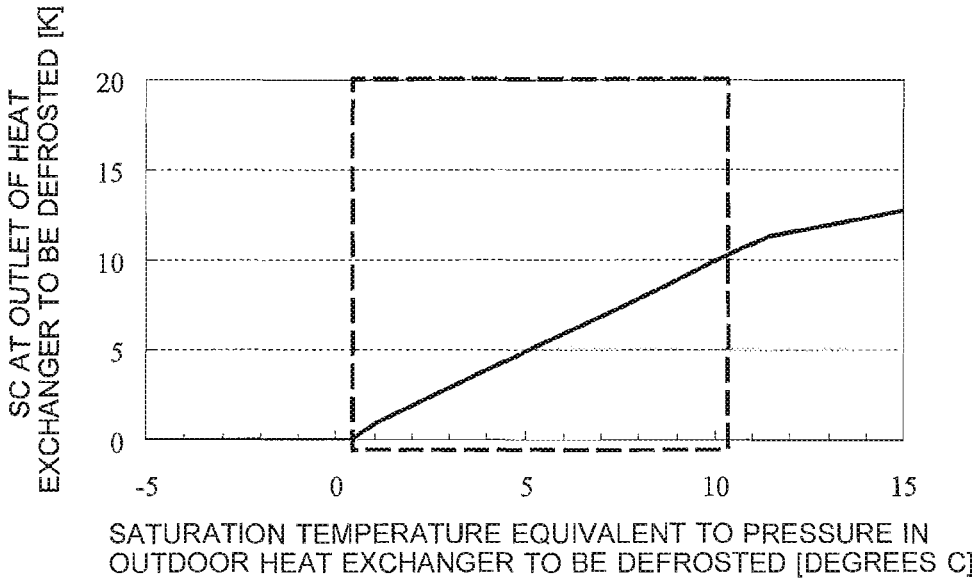
FIG. 16 is a graph showing the degree of subcooling SC of refrigerant at the outlet of the outdoor heat exchanger to be defrosted, with respect to pressure (converted to saturated liquid temperature) in the outdoor heat exchanger to be defrosted in the air-conditioning apparatus 100 according to Embodiment 1 of the present invention.

FIG. 16 is a graph showing the degree of subcooling SC at the outlet of the outdoor heat exchanger 5 to be defrosted, the degree of subcooling SC being calculated by varying the pressure (converted to saturated liquid temperature in the drawing) in the outdoor heat exchanger 5 to be defrosted while the defrosting capacity is fixed, in the air-conditioning apparatus using an R410A refrigerant.

FIG. 12 shows that, in the outdoor heat exchanger 5 to be defrosted, the heating capacity is high when the saturated liquid temperature of the refrigerant is higher than 0 degrees Celsius and lower than or equal to 10 degrees Celsius, and the heating capacity is low otherwise. Reasons for this will be described. To melt frost, the temperature of the refrigerant needs to be higher than 0 degrees Celsius. As can be seen in FIG. 13, if an attempt is made to melt the frost with the saturated liquid temperature being 0 degrees Celsius or below, point (g) becomes higher than the saturated gas enthalpy. Accordingly, the condensation latent heat of the refrigerant cannot be used, and there is only a small difference in enthalpy between before and after the outdoor heat exchanger 5 to be defrosted.

In this case, to achieve the same defrosting capacity as in the optimum range of 0 degrees Celsius to 10 degrees Celsius, the flow rate of refrigerant flowing into the outdoor heat exchanger 5 to be defrosted needs to be about three to four times higher (see FIG. 14). Accordingly, the flow rate of the refrigerant that can be supplied to the indoor units B and C that performs heating is reduced, and hence the heating capacity is lowered.

On the other hand, as the pressure in the outdoor heat exchanger 5 to be defrosted increases, as shown in FIGS. 15 and 16, the degree of subcooling SC at the outlet of the outdoor heat exchanger 5 to be defrosted increases and the refrigerant density also increases. That is, the amount of liquid refrigerant in the outdoor heat exchanger 5 to be defrosted increases, and the required amount of refrigerant increases. In a multi-air-conditioning apparatus for a building, during heating operation, excess refrigerant that does not circulate in the refrigeration cycle is present in a reservoir, such as the accumulator 6. However, as the pressure in the outdoor heat exchanger 5 to be defrosted increases, the required amount of refrigerant increases and the amount of refrigerant accumulated in the accumulator 6 decreases. The accumulator becomes empty at a saturation temperature of about 10 degrees Celsius. When no excess liquid remains in the accumulator 6, the heating capacity is lowered due to, for example, a lack of refrigerant in the refrigeration cycle and a decrease in the suction density of the compressor. Additionally, due to non-uniform distribution of refrigerant temperature in the outdoor heat exchanger 5 to be defrosted, it is difficult to uniformly melt the frost.

For the reasons described above, it is preferable that the pressure in the outdoor heat exchanger 5 to be defrosted be throttled, by the expansion device 10, to be equivalent to a saturation temperature higher than 0 degrees Celsius and lower than or equal to 10 degrees Celsius. In the high-pressure defrosting illustrated in FIG. 5, where the pressure in the outdoor heat exchanger 5 to be defrosted is as high as the discharge pressure of the compressor, that is, the pressure in the outdoor heat exchanger 5 to be defrosted increases, it is preferable that the expansion device 10 be added.

To reduce transfer of refrigerant and prevent non-uniform melting during defrosting while making full use of medium-pressure defrosting that uses latent heat, an optimum target value for the degree of subcooling SC at the outlet of the outdoor heat exchanger 5 to be defrosted is 0 K. Accordingly, when the accuracy of temperature and pressure gauges for detecting the degree of subcooling SC is taken into account, the pressure in the outdoor heat exchanger 5 to be defrosted is preferably set to be equivalent to a saturation temperature higher than 0 degrees Celsius and lower than or equal to 6 degrees Celsius so that the degree of subcooling SC is about 0 K to 5 K.

As described above, when the pressure in the outdoor heat exchanger 5 to be defrosted is set to be equivalent to a saturation temperature of 0 degrees Celsius or higher, it is possible to achieve efficient defrosting and thus to maintain the flow rate of refrigerant that can be supplied to the indoor units B and C in heating operation. However, as the pressure increases, the amount of refrigerant required for use in the outdoor heat exchanger 5 to be defrosted increases. Next, a method of supplying refrigerant to the outdoor heat exchanger 5 to be defrosted will be described.

As can be seen in FIG. 15, to perform medium-pressure defrosting or high-pressure defrosting that can provide efficient defrosting, a mean refrigerant density in the outdoor heat exchanger 5 to be defrosted needs to be increased to 600 $kg/m^3$ or higher in the process of switching from the heating operation to the heating-defrosting operation.

To quickly supply refrigerant to the outdoor heat exchanger 5 to be defrosted, the solenoid valve 16 is opened to discharge liquid refrigerant from the bottom of the accumulator 6 where excess refrigerant is accumulated, through the first bypass pipe 16*a*. By allowing the liquid refrigerant to return to the compressor 1 to increase the suction density and thus to increase the amount of refrigerant circulation, the refrigerant can be more quickly transferred to the outdoor heat exchanger 5 to be defrosted.

At a saturation temperature of 0 degrees Celsius, the gas density of R410A is 30 kg/m$^3$ and the liquid density of R410A is 1200 kg/m$^3$. Accordingly, from a mean density calculation expression. 600 kg/m$^3$ (which is a condition of mean refrigerant density in the outdoor heat exchanger 5 to be defrosted) is found to be equivalent to a quality of about 0 to 0.2. The temperature of frost is unchanged at 0 degrees Celsius. Therefore, even when a different refrigerant is used, it is only necessary to accumulate the refrigerant in the outdoor heat exchanger 5 to be defrosted such that its density is equivalent to a quality of 0 to 0.2 at a pressure corresponding to a saturated liquid temperature of 0 degrees Celsius.

If too much liquid is returned to the compressor, oil in the compressor is diluted. Hence, there is an upper limit to the amount of liquid that can be returned. To prevent degradation in the reliability of the compressor, the amount of liquid returned to the compressor is limited to the allowable upper limit or less by the resistance of the expansion device 17.

To improve reliability of the compressor, it is preferable to prevent return of liquid as much as possible. When the suction pressure of the compressor is high because of, for example, high outdoor air temperature, a large amount of refrigerant circulates in the refrigerant circuit. Therefore, the solenoid valve 16 may be opened only when the suction pressure drops because of, for example, low outdoor air temperature.

When the outdoor air temperature is 0 degrees Celsius or above, frost melts by exchanging heat with the outdoor air. Therefore, the outdoor air temperature threshold may be set to about 0 degrees Celsius. The pressure threshold may be set to about 0.3 MPa in the case of R410A. If an excessive amount of liquid is returned to the compressor by opening the solenoid valve 16, the discharge temperature of the compressor, the degree of discharge superheat, or the shell temperature of the compressor may fall below a predetermined value. By adding a control operation that closes the solenoid valve 16 in this case, degradation in the reliability of the compressor can be reduced.

An operation of the expansion device 10 and the second flow control devices 7-1 and 7-2 during heating-defrosting operation will now be described.

In the heating-defrosting operation, the controller 30 controls the opening degree of the second flow control device 7-2 such that the pressure in the parallel heat exchanger 5-2 to be defrosted is equivalent to a saturation temperature of about 0 degrees Celsius to 10 degrees Celsius. To improve controllability by generating a difference in pressure between before and after the second flow control device 7-2, the second flow control device 7-1 is brought into a fully opened state. During the heating-defrosting operation, the difference between the discharge pressure of the compressor 1 and the pressure in the parallel heat exchanger 5-2 to be defrosted does not change significantly. Therefore, the opening degree of the expansion device 10 is set to a fixed value in accordance with a required defrosting flow rate designed in advance.

Heat emitted from the refrigerant used for defrosting is not only transferred to the frost on the parallel heat exchanger 5-2, but may be partially released to the outdoor air. Therefore, the controller 30 may be configured to control the expansion device 10 and the second flow control device 7-2 such that the defrosting flow rate increases as the outdoor air temperature decreases. Thus, the amount of heat applied to the frost and the amount of time required for defrosting can be made constant, regardless of the outdoor air temperature.

The controller 30 may change the saturation temperature threshold used to determine whether frost has formed, or may change the duration of normal operation, in accordance with the outdoor air temperature.

That is, as the outdoor air temperature decreases, the duration of normal heating operation is shortened so that the amount of frost at the start of heating-defrosting operation is constant. Thus, a constant amount of heat can be applied from the refrigerant to the frost during the heating-defrosting operation.

This eliminates the need to control the defrosting flow rate using the expansion device 10, so that an inexpensive capillary tube with a constant flow resistance can be used as the expansion device 10.

The controller 30 may set an outdoor air temperature threshold. Then, the controller 30 may perform a heating-defrosting operation when the outdoor air temperature is higher than or equal to the threshold (e.g., when the outdoor air temperature is −5 degrees Celsius or −10 degrees Celsius), and may perform, when the outdoor air temperature is lower than the threshold, a heating-suspended defrosting operation where the heating operation of the indoor unit is stopped to defrost the entire surface of the plurality of parallel heat exchangers.

When the outdoor air temperature is as low as 0 degrees Celsius or lower (e.g., −5 degrees Celsius or −10 degrees Celsius), the absolute humidity of the outdoor air is naturally low and the amount of frost is small, and hence the normal operation continues for a long time before the amount of frost reaches a certain level. Even when the heating operation of the indoor unit is stopped to defrost the entire surface of the plurality of parallel heat exchangers, the ratio of the duration in which the heating operation of the indoor unit is suspended is small. In the heating-defrosting operation, when transfer of heat from the outdoor heat exchanger 5 to be defrosted into the outdoor air is taken into account, efficient defrosting can be achieved by selectively performing one of the heating-defrosting operation and the heating-suspended defrosting operation in accordance with the outdoor air temperature.

In the heating-suspended defrosting operation, the flow switching device 2 is set to OFF, the second flow control devices 7-1 and 7-2 are fully opened, the first solenoid valves 8-1 and 8-2 are set to ON, the second solenoid valves 9-1 and 9-2 are set to OFF, the expansion device 10 is closed, and the solenoid valve 16 is opened or closed depending on the outdoor air temperature or the suction pressure of the compressor 1. This allows high-temperature and high-pressure gas refrigerant discharged from the compressor 1 to pass through the flow switching device 2 and the first solenoid valves 8-1 and 8-2, and flows into the parallel heat exchangers 5-1 and 5-2, so that the frost on the parallel heat exchangers 5-1 and 5-2 can be melted.

In Embodiment 1, the parallel heat exchangers 5-1 and 5-2 are formed as an integral unit, and the outdoor air is conveyed by the outdoor fan 5*f* to the parallel heat exchanger to be defrosted. In this case, to reduce the amount of heat released during heating-defrosting operation, the fan output may be reduced as the outdoor air temperature decreases.

[Control Flow]

Figure 17:
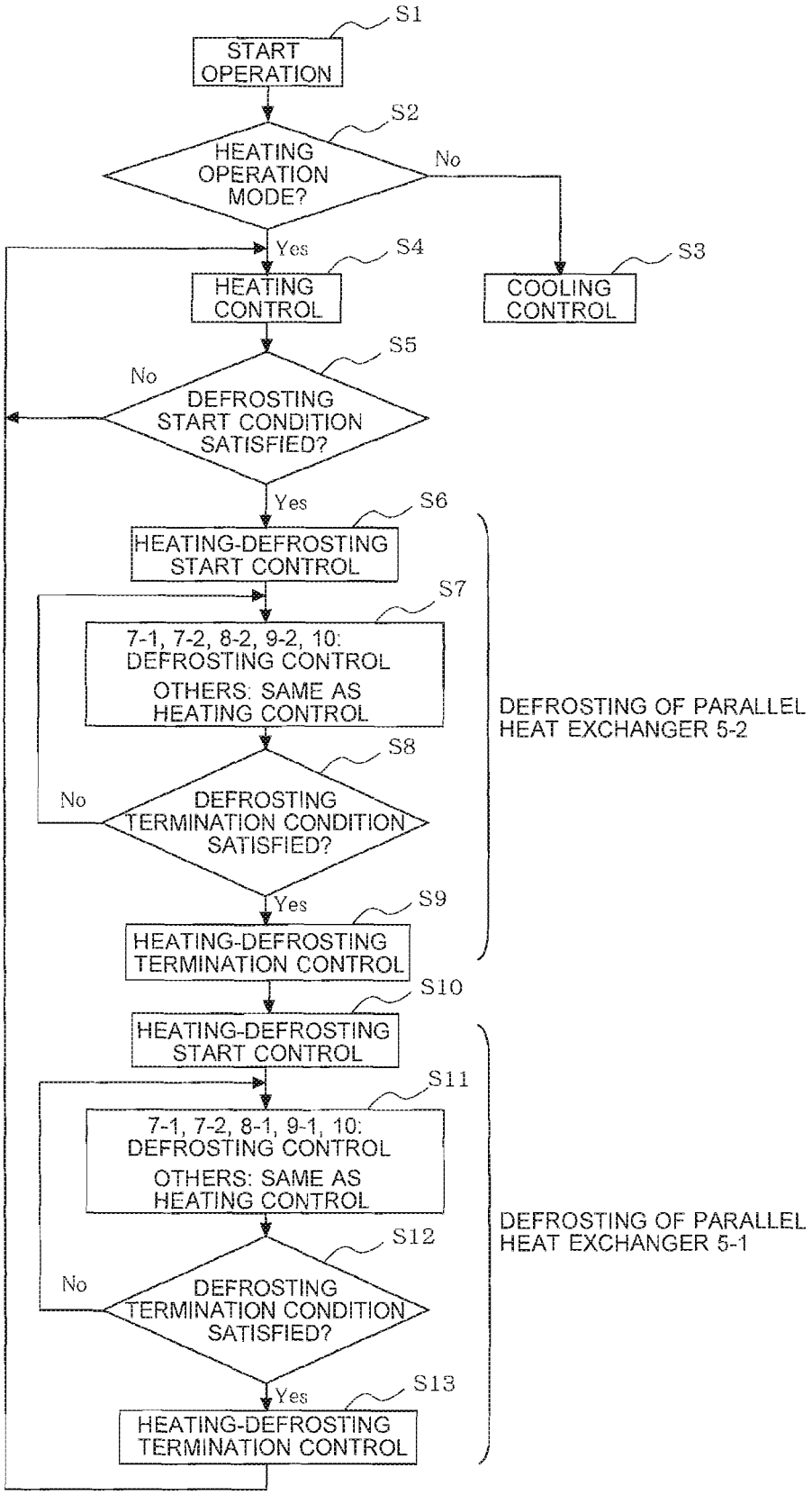
FIG. 17 is a control flow of the air-conditioning apparatus 100 according to Embodiment 1 of the present invention.

FIG. 17 is a control flow of the air-conditioning apparatus 100 according to Embodiment 1 of the present invention.

When the operation is started (S1), a determination is made as to whether the operation mode of the indoor units B and C is either cooling or heating operation (S2), and control of the normal cooling operation (S3) or normal heating operation (S4) is performed. In the heating operation, by taking into account degradation in the heat transfer performance of the outdoor heat exchanger 5 caused by a decrease in heat transfer and air volume resulting from frost formation, a determination is made as to whether a condition for starting a defrosting operation, such as that represented by expression (1), is satisfied (i.e., whether frost has formed is determined) (S5):

$$(\text{saturation temperature corresponding to suction pressure}) < (\text{outdoor air temperature}) - x1 \quad (1)$$

where x1 may be set to about 10 K to 20 K.

If expression (1) is satisfied, the heating-defrosting operation is started to alternately defrost the parallel heat exchangers (S6). In this example, control is performed such that the parallel heat exchanger 5-2 on the lower side of the outdoor heat exchanger 5 and the parallel heat exchanger 5-1 on the upper side of the outdoor heat exchanger 5 (see FIG. 2) are defrosted in this order. The defrosting order may be reversed. In the normal heating operation before the heating-defrosting operation is entered, the ON/OFF state of each valve is as shown in the column of "NORMAL HEATING OPERATION" in Table 1. The state of each valve is then changed to that shown in "5-1: EVAPORATOR, 5-2: DEFROSTING" under "HEATING-DEFROSTING OPERATION" in Table 1 to start the heating-defrosting operation (S6).

(a) first solenoid valve 8-2: OFF (b) second solenoid valve 9-2: ON (c) solenoid valve 16: ON (d) expansion device 10: opened (e) second flow control device 7-1: fully opened (f) second flow control device 7-2: control started Until frost on the parallel heat exchanger 5-2 to be defrosted melts and a condition for terminating the defrosting is satisfied, the parallel heat exchanger 5-2 continues to be defrosted and the heating-defrosting operation using the parallel heat exchanger 5-1 as an evaporator continues (S7, S8). When the frost on the parallel heat exchanger 5-2 starts to melt as the heating-defrosting operation continues, the refrigerant temperature in the first connection pipe 13-2 rises. Therefore, the defrosting may be determined to be terminated when, for example, the temperature detected by a temperature sensor attached to the first connection pipe 13-2 exceeds the threshold as represented by expression (2):

$$(\text{refrigerant temperature in injection pipe (e.g., first connection pipe 13-2)}) > x2 \quad (2)$$

where x2 may be set to 5 degrees Celsius to 10 degrees Celsius.

When expression (2) is satisfied, the heating-defrosting operation for defrosting the parallel heat exchanger 5-2 is terminated (S9).

(a) second solenoid valve 9-2: OFF (b) first solenoid valve 8-2: ON (c) second flow control devices 7-1 and 7-2: normal intermediate-pressure control Then, the state of each valve is changed to that shown in "5-1: DEFROSTING, 5-2: EVAPORATOR," under "HEATING-DEFROSTING OPERATION" in Table 1 to start the heating-defrosting operation for defrosting the parallel heat exchanger 5-1 in turn. The description of (S10) to (S13) will be omitted, as it is the same as that of (36) to (S9) except for the valve numbers.

By defrosting the parallel heat exchanger 5-2 and the parallel heat exchanger 5-1 on the upper and lower sides, respectively, of the outdoor heat exchanger 5 in this order as described above, it is possible to prevent formation of a continuous ice cover. When defrosting of both the parallel heat exchanger 5-2 on the upper side and the parallel heat exchanger 5-1 on the lower side is completed, and thus the heating-defrosting operation in (S6) to (S13) ends, the process returns to the normal heating operation in (S4).

When the heating-defrosting operation mode is entered, the outdoor heat exchanger 5 divided into a plurality of units is defrosted at least once. When the outdoor heat exchanger 5 defrosted last is returned to the heating operation, if it is determined (e.g., from the temperature sensor provided in the refrigerant circuit) that frost is on the outdoor heat exchanger 5 defrosted first and its heat transfer performance is degraded, the outdoor heat exchanger 5 defrosted first may be briefly defrosted for the second time.

Embodiment 1 provides the following advantageous effects, as well as the above-described effect of enabling continuous indoor heating while carrying out defrosting in the heating-defrosting operation.

That is, the refrigerant flowing out of the parallel heat exchanger 5-2 to be defrosted is allowed to flow into the main circuit on the upstream side of the parallel heat exchanger 5-1, which is not to be defrosted. This can improve efficiency of defrosting.

Also, a part of high-temperature and high-pressure gas refrigerant branching off the discharge pipe 1*a* is reduced in pressure to a level equivalent to a saturation temperature of about 0 degrees Celsius to 10 degrees Celsius, which is higher than the temperature of frost, and allowed to flow into the outdoor heat exchanger 5 to be defrosted. The condensation latent heat of the refrigerant can thus be used.

Also, the liquid refrigerant is taken out directly from the bottom of the accumulator 6 to increase the flow rate of refrigerant circulated by the compressor 1. This allows necessary refrigerant to be quickly supplied to the parallel heat exchanger 5-2 to be defrosted.

Since the saturation temperature, which is about 0 degrees Celsius to 10 degrees Celsius, has only a small difference from the frost temperature, the degree of subcooling at the outlet of the outdoor heat exchanger 5 to be defrosted is as small as about 5 K. Therefore, the amount of refrigerant required for the outdoor heat exchanger 5 to be defrosted can be reduced, and hence the time required to start efficient defrosting can be shortened.

Also, since a larger part of refrigerant in the heat transfer tubes of the outdoor heat exchanger 5 to be defrosted is two-phase gas-liquid refrigerant, and hence a temperature difference from the frost temperature is constant in a larger area, the entire heat exchanger can be defrosted uniformly.

Also, by allowing the refrigerant flowing out of the outdoor heat exchanger 5 to be defrosted to flow into the outdoor heat exchanger 5 serving as an evaporator, it is possible to maintain the evaporation performance in the refrigeration cycle, and reduce a decrease in suction pressure.

Also, the expansion device 17 can prevent a large amount of liquid from returning to the compressor 1.

A condition for opening and closing the solenoid valve 16 is determined by sensing the suction pressure, the discharge temperature, and the shell temperature of the compressor. This makes it possible to prevent excess liquid from returning to the compressor 1.

The defrosting capacity can be varied by controlling the flow rate in the expansion device 10.

By increasing the flow rate in the expansion device 10 at low outdoor air temperature, the time required for defrosting can be made constant.

Embodiment 2

Figure 18:
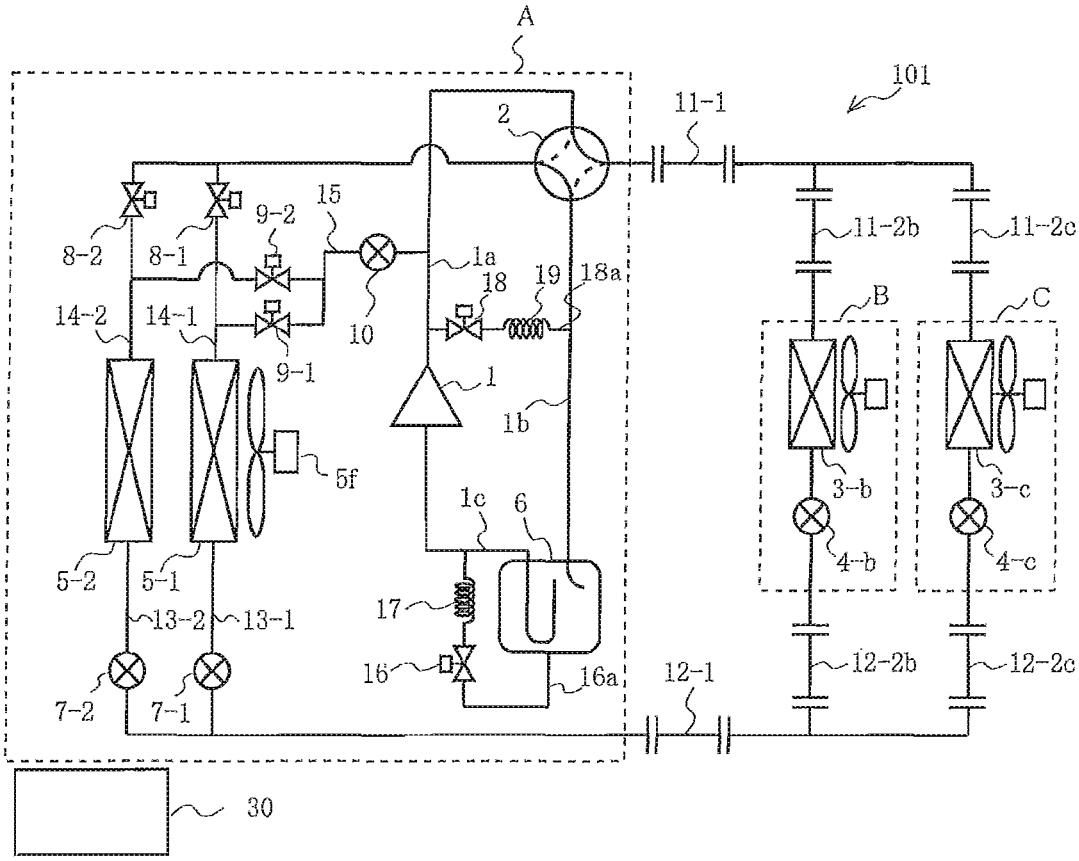
FIG. 18 is a refrigerant circuit diagram illustrating a configuration of a refrigerant circuit of an air-conditioning apparatus 101 according to Embodiment 2 of the present invention.

FIG. 18 is a refrigerant circuit diagram illustrating a configuration of a refrigerant circuit of an air-conditioning apparatus 101 according to Embodiment 2 of the present invention.

The following description of the air-conditioning apparatus 101 will be focused on differences from Embodiment 1.

In addition to the components of the air-conditioning apparatus 100 according to Embodiment 1, the air-conditioning apparatus 101 of Embodiment 2 includes a second bypass pipe 18*a* connected to the discharge pipe 1*a* and the suction pipe 1*b* of the compressor. The second bypass pipe 18*a* is provided with a solenoid valve 18 and an expansion device 19. The solenoid valve 18 may be reduced in size to add a pressure loss to the refrigerant flowing through the solenoid valve, and then to remove the expansion device 19.

The solenoid valve 18 and the expansion device 19 in Embodiment 2 correspond to "second expansion device" of the present invention.

At the start of heating-defrosting operation, when the amount of refrigerant circulation is reduced by a decrease in the suction pressure of the compressor caused by, for example, a decrease in outdoor air temperature, the controller 30 opens the solenoid valve 18 if determining that it is necessary to increase the speed of discharging the liquid accumulated in the accumulator 6. This opens a second liquid refrigerant transporting circuit formed by sequentially connecting the compressor 1, the second bypass pipe 18*a*, the solenoid valve 18, the expansion device 19, and the accumulator 6. When high-temperature gas refrigerant discharged from the compressor flows into the accumulator 6, the liquid refrigerant accumulated in the accumulator 6 is evaporated. This allows high-density gas refrigerant to be suctioned into the compressor, so that the amount of refrigerant circulation can be increased.

An example of suction pressure criteria for determining whether to open or close the solenoid valve 18 will now be described. To supply, to an indoor space, air having a temperature that does not lead to user discomfort caused by cold air, the indoor heat exchangers 3-*b* and 3-*c* need to generate a temperature difference greater than or equal to a predetermined value (e.g., 10 degrees Celsius or higher) between the indoor temperature and the saturation temperature converted from the refrigerant pressure in the indoor heat exchangers 3-*b* and 3-*c*.

For example, a Japanese Industrial Standard JIS-B8616 for performance tests on package air conditioners states that the indoor temperature during heating operation is 20 degrees Celsius. The saturation temperature of the refrigerant in this case needs to be 30 degrees Celsius or higher, and the suction pressure of the compressor needs to be about 0.3 MPa in the case of R410A. Since the refrigerant density significantly decreases as the suction pressure decreases, the solenoid valve 18 may be opened in the case of 0.3 MPa or lower.

Figure 19:
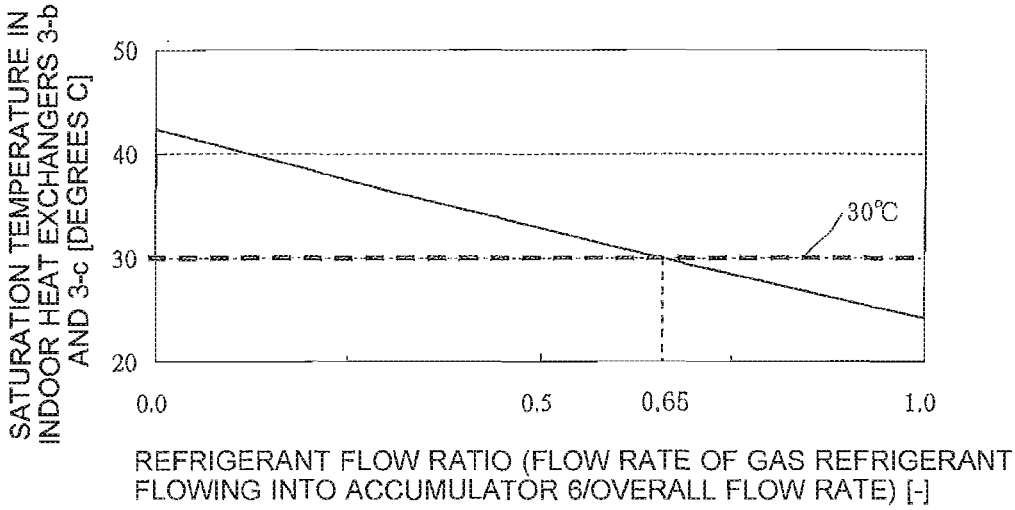
FIG. 19 is a graph showing a saturation temperature in indoor heat exchangers 3-*b* and 3-*c*, with respect to the flow rate of gas allowed to flow into the accumulator 6 in the air-conditioning apparatus 101 according to Embodiment 2 of the present invention.

FIG. 19 shows a saturation temperature in the indoor heat exchangers 3-*b* and 3-*c* with respect to the flow rate of gas refrigerant flowing through the solenoid valve 18 into the accumulator 6. To supply refrigerant faster than to the outdoor heat exchanger 5 to be defrosted, the flow rate of gas refrigerant may be increased. However, FIG. 19 shows that as the flow rate of gas refrigerant increases, the saturation temperature of the refrigerant in the indoor heat exchangers 3-*b* and 3-*c* decreases. Accordingly, to maintain the saturation temperature of refrigerant at 30 degrees Celsius that ensures a temperature difference of 10 degrees Celsius or more from an indoor air temperature of about 20 degrees Celsius, a gas refrigerant flow ratio, which is the ratio of the flow rate of gas refrigerant supplied to the accumulator 6 with respect to the overall flow rate of gas refrigerant, needs to be set below 0.65. Accordingly, the resistance of the solenoid valve 18 and the expansion device 19 may be determined such that the gas refrigerant flow ratio is below 0.65.

Figure 20:
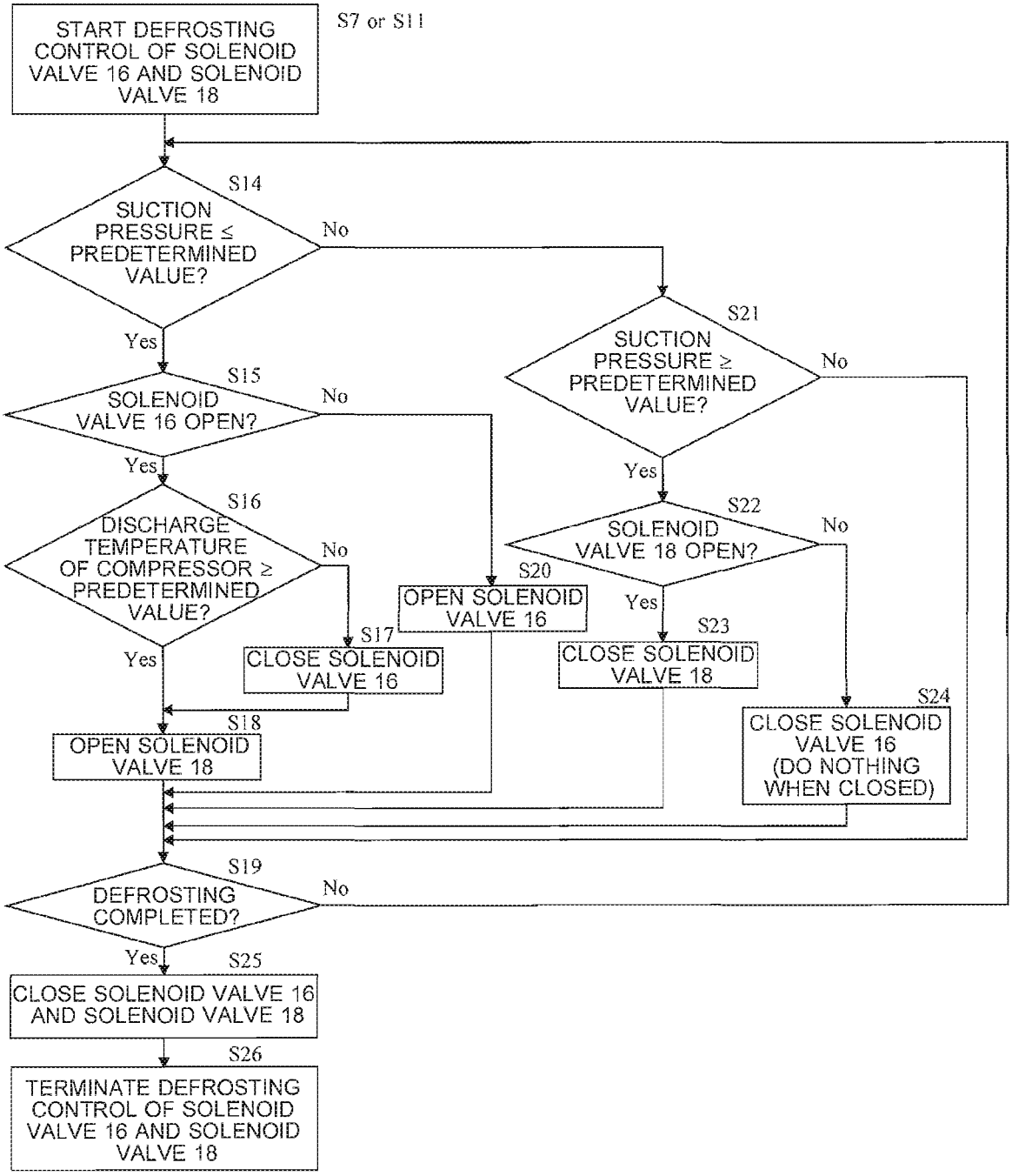
FIG. 20 is a control flow of the air-conditioning apparatus 101 according to Embodiment 2 of the present invention.

FIG. 20 is a control flow of the air-conditioning apparatus 101 according to Embodiment 2.

This control flow shows how the solenoid valve 16 and the solenoid valve 18 are controlled under the defrosting control of the air-conditioning apparatus 101.

When the defrosting control is started (S7 or S11), a determination as to whether liquid refrigerant needs to be discharged from the accumulator 6 is made by determining whether the suction pressure is lower than or equal to a predetermined value (e.g., 0.3 MPa) (S14). This determination may be made using other criteria, such as whether the outdoor air temperature is 0 degrees Celsius or lower, as described above. If it is determined in S14 that the liquid refrigerant needs to be discharged because, for example, the suction pressure is lower than the predetermined value, the operation for opening the solenoid valve 16 and the solenoid valve 18 is performed (S15 to S20).

Since opening the solenoid valve 16 allows liquid to return from the accumulator 6 to the compressor 1, a determination as to whether the discharge temperature of the compressor 1 is higher than a predeterrnined value may be made, as in S16, to determine whether the solenoid valve 16 is to be kept open. For the determination in S16, as described above, whether the degree of discharge superheat in the compressor is greater than or equal to a predetermined value (e.g., 10 degrees Celsius), or whether a measured shell temperature of the compressor reaches a predetermined value (e.g., whether a difference between the shell temperature and the saturation temperature calculated from the suction pressure is 10 degrees Celsius or more), may be used as a criterion.

If the suction pressure drops even when the solenoid valve 16 is open, the solenoid valve 18 is opened to allow the liquid in the accumulator 6 to evaporate, and thus to increase the suction pressure. As in S21 to S24, if the suction pressure is fully recovered and it is no longer needed to discharge the refrigerant from the accumulator 6, the solenoid valve 18 and the solenoid valve 16 are closed sequentially. Also, if, from expression (2) described above, the defrosting is determined to have completed, the solenoid valve 18 and the solenoid valve 16 are closed to end the control performed during the defrosting. The predetermined value used in S21 may be set to a value greater than or equal to the predetermined value used in S14. When the predetermined value in S21 is the same as that in S14, the solenoid valves are always opened or closed unless the suction pressure is equal to the predetermined value. For example, if the predetermined value in S14 is set to 0.3 MPa and the predetermined value in S21 is set to 0.5 MPa to 0.6 MPa to create a region where the solenoid valves are neither opened nor closed, it is possible to achieve stable defrosting control.

As described above, during defrosting, the supply of refrigerant from the accumulator 6 to the outdoor heat exchanger 5 to be defrosted is basically done by transferring the liquid refrigerant using the first bypass pipe 16*a* and the first expansion device (solenoid valve 16). Then, if the supply is still insufficient, the amount of refrigerant circulation is increased by allowing the liquid in the accumulator 6 to evaporate using the second bypass pipe 18*a* and the second expansion device (solenoid valve 18).

A second liquid refrigerant transporting unit formed by the second bypass pipe 18*a* is thus provided. By using the second liquid refrigerant transporting unit for increasing the flow rate of gas from the accumulator 6, as well as the first liquid refrigerant transporting unit for returning liquid described in Embodiment 1, a faster transfer of refrigerant can be achieved.

Embodiment 3

Figure 21:
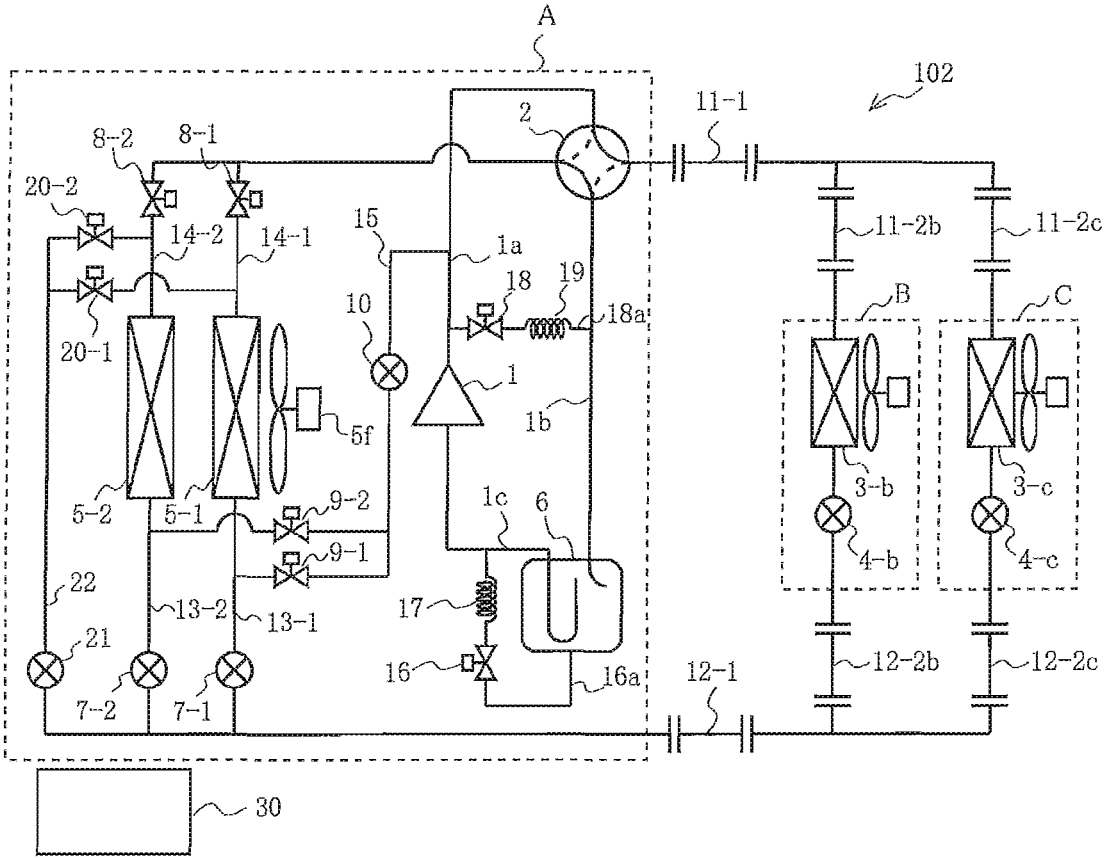
FIG. 21 is a refrigerant circuit diagram illustrating a configuration of a refrigerant circuit of an air-conditioning apparatus 102 according to Embodiment 3 of the present invention.

FIG. 21 is a refrigerant circuit diagram illustrating a configuration of a refrigerant circuit of an air-conditioning apparatus 102 according to Embodiment 3 of the present invention.

The following description of the air-conditioning apparatus 102 will be focused on differences from Embodiment 2.

Unlike the configuration of the air-conditioning apparatus 101 according to Embodiment 2, the first defrosting pipe 15 in the air-conditioning apparatus 102 of Embodiment 3 is connected to the first connection pipes 13-1 and 13-2.

At the same time, in addition to the components of the air-conditioning apparatus 100 according to Embodiment 1, the air-conditioning apparatus 102 includes a second defrosting pipe 22 that connects a pipe of a main circuit (between the second extension pipe 12-1 and the second flow control devices 7-1 and 7-2) to the second connection pipes 14-1 and 14-2.

The second defrosting pipe 22 is provided with a third flow control device 21, which is a valve capable of varying the opening degree. For example, the third flow control device 21 is formed by an electronically controlled expansion valve. The second defrosting pipe 22 is also provided with solenoid valves 20-1 and 20-2 corresponding to the second connection pipes 14-1 and 14-2, respectively.

The third flow control device 21 according to Embodiment 3 corresponds to "fourth expansion device" of the present invention.

Upon detecting that defrosting is required for removal of frost during normal heating operation, the controller 30 closes the second solenoid valve 8-2 corresponding to the parallel heat exchanger 5-2 to be defrosted, and fully opens the second flow control device 7-2. Then, the controller 30 opens the second solenoid valve 9-2, and opens the expansion device 10 to a predetermined opening degree. Also, the controller 30 opens the solenoid valve 20-2 corresponding to the parallel heat exchanger 5-2 to be defrosted, and opens the third flow control device 21 to a certain opening degree.

This opens a medium-pressure defrosting circuit formed by sequentially connecting the compressor 1, the expansion device 10, the second solenoid valve 9-2, the parallel heat exchanger 5-2, the solenoid valve 20-2, the third flow control device 21, and the second flow control device 7-1, thereby starting a heating-defrosting operation.

In the heating-defrosting operation, the controller 30 controls the opening degree of the third flow control device 21 such that the pressure (medium pressure) in the parallel heat exchanger 5-2 to be defrosted is equivalent to a saturation temperature of about 0 degrees Celsius to 10 degrees Celsius.

As in Embodiments 1 and 2, the liquid refrigerant accumulated in the accumulator 6 can be discharged by opening the solenoid valve 16. Also, as in Embodiment 2, opening the solenoid valve 18 allows high-temperature gas refrigerant to flow into the accumulator 6, so that the liquid refrigerant accumulated in the accumulator 6 can be evaporated and discharged.

A determination of whether to start defrosting is made in the same manner as in FIG. 17. That is, when the operation is started (S1), a determination is made as to whether the operation mode of the indoor units B and C is either cooling or heating operation (S2), and control of the normal cooling operation (S3) or normal heating operation (S4) is performed. In the heating operation, by taking into account degradation in the heat transfer performance of the outdoor heat exchanger 5 caused by a decrease in heat transfer and air volume resulting from frost formation, a determination is made as to whether a condition for starting a defrosting operation, such as that represented by expression (1), is satisfied (i.e., whether frost has formed is determined) (S5).

In the heating-defrosting operation of Embodiment 3, a part of high-temperature and high-pressure refrigerant discharged from the compressor 1 passes through the first defrosting pipe 15, flows into the first connection pipe 13-2, and is supplied to the parallel heat exchanger 5-2 to be defrosted. After being used for defrosting, the refrigerant passes through the second defrosting pipe 22 and joins the main circuit from the first connection pipe 13-1.

As illustrated in FIG. 21, the first connection pipes 13-1 and 13-2 are connected to the heat transfer tubes 5*a* on the upstream side of the parallel heat exchangers 5-1 and 5-2 in the direction of air flow. The heat transfer tubes 5*a* of the parallel heat exchangers 5-1 and 5-2 are arranged in a plurality of rows in the direction of air flow, so that air flows toward rows on the downstream side.

Accordingly, the refrigerant supplied to the parallel heat exchanger 5-2 to be defrosted flows from the heat transfer tubes 5*a* on the upstream side toward the downstream side in the direction of air flow, so that the direction of refrigerant flow can coincide with the direction of air flow (parallel flow).

As described above, in Embodiment 3, the direction of refrigerant flow in the outdoor heat exchanger 5 to be defrosted can coincide with the direction of air flow. Since the refrigerant flow is parallel with the air flow, heat transferred to air during defrosting can be used to remove frost on the fins 5*b* on the downstream side. This can improve efficiency of defrosting.

Embodiment 4

Figure 22:
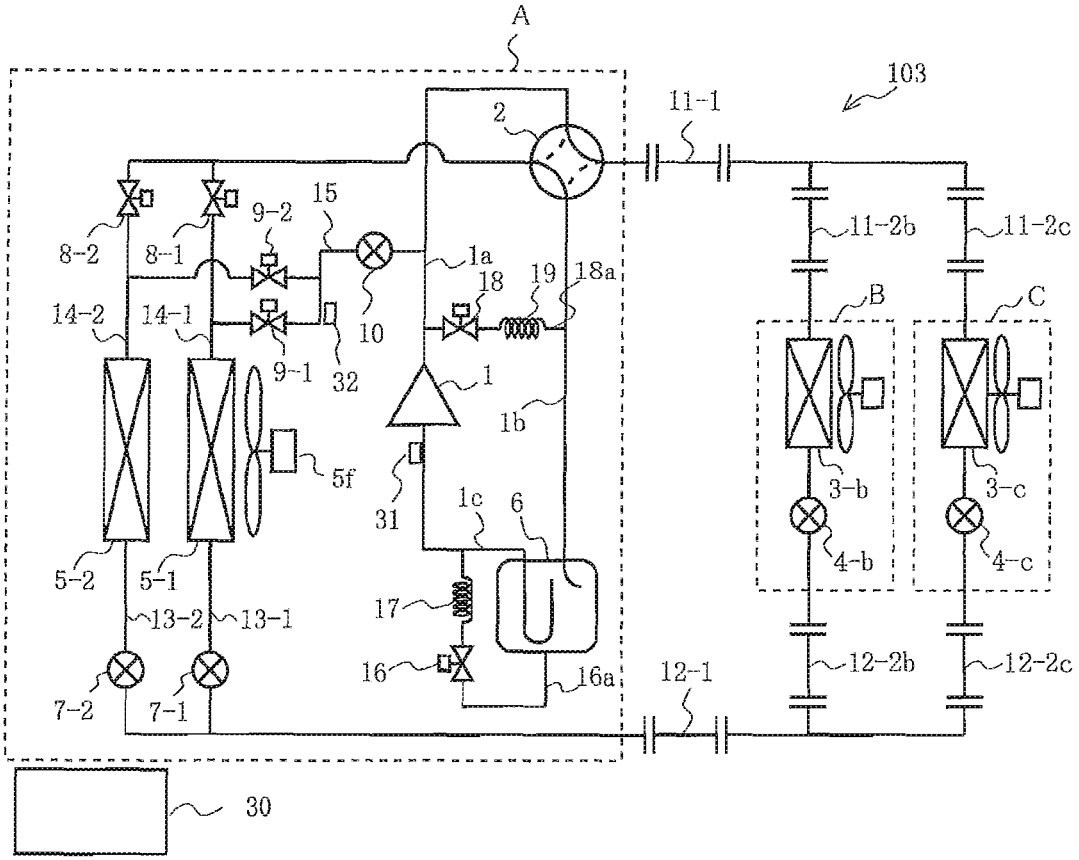
FIG. 22 is a refrigerant circuit diagram illustrating a configuration of a refrigerant circuit of an air-conditioning apparatus 103 according to Embodiment 4 of the present invention.

FIG. 22 is a refrigerant circuit diagram illustrating a configuration of a refrigerant circuit of an air-conditioning apparatus 103 according to Embodiment 4 of the present invention.

Embodiment 4 describes details of how the solenoid valve 16 and the solenoid valve 18 operate in a refrigerant transfer control operation performed before the start of medium-pressure defrosting.

The following description of the air-conditioning apparatus 103 will be focused on differences from the air-conditioning apparatus 101 of Embodiment 2. The suction pipe 1*c* of the compressor 1 is provided with a suction pressure sensor 31 that measures the suction pressure of the compressor 1, and the first defrosting pipe 15 is provided with a pressure sensor 32 that measures the pressure in the outdoor heat exchanger 5 during defrosting. The pressure sensor 32 may be attached to the first connection pipe 13 or to the second connection pipe 14, as long as it can measure the pressure in the outdoor heat exchanger 5 during defrosting. The description of the refrigerant circuit diagram of Embodiment 1 will be omitted here, as the refrigerant circuit of Embodiment 1 and the refrigerant circuit of Embodiment 2 are identical, except for the presence or absence of the solenoid valve 18 and the expansion device 19.

As described with reference to FIG. 15 in Embodiment 1, to perform efficient medium-pressure defrosting that uses condensation latent heat of the refrigerant, the refrigerant density in the outdoor heat exchanger 5 to be defrosted needs to be increased, that is, the refrigerant needs to be transferred to the outdoor heat exchanger 5 to be defrosted. Accordingly, the heating-defrosting operation requires a refrigerant transfer control operation performed in the initial stage of defrosting before the start of medium-pressure defrosting, and a regular control operation for performing a medium-pressure defrosting operation after the transfer of the refrigerant.

To shorten the time required for defrosting, it is important to quickly transfer a required amount of refrigerant to the outdoor heat exchanger 5 to be defrosted to perform a regular control operation. Accordingly, the refrigerant liquid accumulated at the bottom of the accumulator 6 is transferred to the outdoor heat exchanger 5 to be defrosted.

Specifically, the solenoid valve 16 is opened to transfer the refrigerant liquid accumulated at the bottom of the accumulator 6 to the outdoor heat exchanger 5 to be defrosted, through the first bypass pipe 16*a*, the solenoid valve 16 in the first bypass pipe 16*a*, the expansion device 17, the suction pipe 1*c* of the compressor, the compressor 1, the discharge pipe 1*a* of the compressor 1, the first defrosting pipe 15, and the expansion device 10 in the first defrosting pipe 15.

In the refrigerant circuit of Embodiment 2, the solenoid valve 18 is opened to allow hot gas discharged from the compressor 1 to flow through the second bypass pipe 18*a* into the accumulator 6. This allows the refrigerant liquid accumulated in the accumulator 6 to evaporate and return to the compressor 1, and allows the refrigerant to be more quickly transferred.

Figure 23:
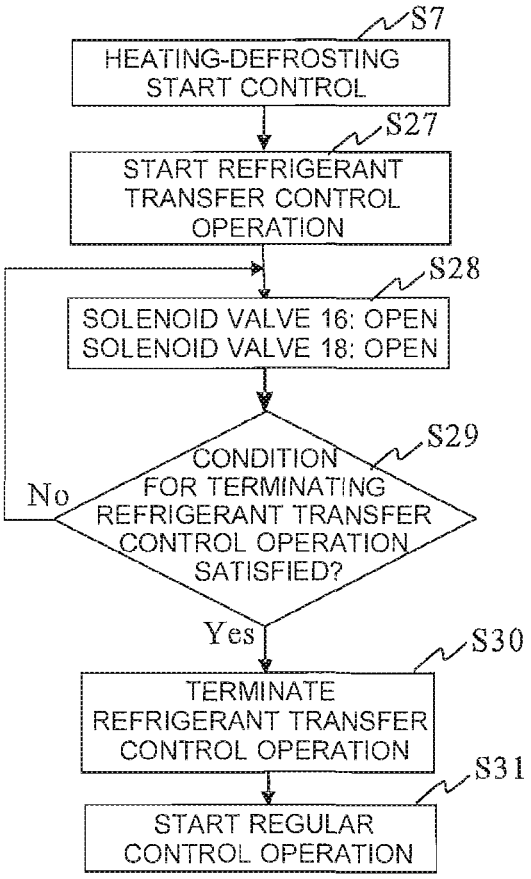
FIG. 23 is a control flow in a refrigerant transfer control operation according to Embodiment 4 of the present invention.

FIG. 23 is a control flow in a refrigerant transfer control operation according to Embodiment 4 of the present invention.

When heating-defrosting control is started (S7), a refrigerant transfer control operation is started (S27) and the solenoid valve 16 and the solenoid valve 18 are opened (S28). Note that only the solenoid valve 16 is opened in the refrigerant circuit of Embodiment 1. The control operation in S28 is continued until a termination condition for terminating the refrigerant transfer control operation is satisfied (S29). The termination condition is, for example, that a value detected by the pressure sensor 32 reaches a level equivalent to a saturation temperature set between 0 degrees Celsius and 10 degrees Celsius as a target value. The sensor's measurement errors may be taken into account, and the minimum duration (e.g., two minutes) and the maximum duration (e.g., six minutes) may be set as a shortest operating condition and a longest operating condition, respectively, for the refrigerant transfer control operation and used as termination conditions.

If the termination condition is satisfied in S29, the refrigerant transfer control operation is terminated (S30), and the process proceeds to a regular control operation (S31). At the termination of the refrigerant transfer control operation (S30), the solenoid valve 16 and the solenoid valve 18 are controlled to be closed. However, for example, if a value measured by the suction pressure sensor 31 is lower than a predetermined value (e.g., 0.3 MPa) or the outdoor air temperature is lower than a predetermined value (e.g., 0 degrees Celsius), and hence it is determined that the amount of refrigerant circulating in the refrigeration cycle needs to be further increased, the solenoid valve 16 and the solenoid valve 18 are open even in the regular control operation. This allows smooth transition from the refrigerant transfer control operation to the regular control operation.

Although Embodiments 1 to 4 deal with an example where the outdoor heat exchanger 5 is divided, the present invention is not limited to this. By applying the above-described idea of the present invention to the configuration including a plurality of separate outdoor heat exchangers 5 connected in parallel with each other, one of the outdoor heat exchangers 5 can be subjected to defrosting while another outdoor heat exchanger 5 continues to perform a heating operation.

REFERENCE SIGNS LIST

1: compressor, 1*a*: discharge pipe, 1*b*: suction pipe, 1*c*: suction pipe, 2: flow switching device (four-way valve), 2-1: four-way valve, 2-2: four-way valve, 2-3: four-way valve, 3-*b*: indoor heat exchanger, 3-*c*: indoor heat exchanger, 4-*b*: first flow control device, 4-*c*: first flow control device, 5-1: parallel heat exchanger, 5-2: parallel heat exchanger, 5: outdoor heat exchanger, 5*a*: heat transfer tube, 5*b*: fin, 5*f*: outdoor fan, 6: accumulator, 7-1: second flow control device, 7-2: second flow control device, 8-1: first solenoid valve, 8-2: first solenoid valve, 9-1: second solenoid valve, 9-2: second solenoid valve, 10: expansion device, 11-1: first extension pipe, 11-2*b*: first extension pipe, 11-2*c*: first extension pipe, 12-1: second extension pipe, 12-2*b*: second extension pipe, 12-2*c*: second extension pipe, 13-1: first connection pipe, 13-2: first connection pipe, 14-1: second connection pipe, 14-2: second connection pipe, 15: first defrosting pipe, 16: solenoid valve, 16*a*: first bypass pipe, 17: expansion device, 18: solenoid valve, 18*a*: second bypass pipe, 19: expansion device, 20-1: solenoid valve, 20-2: solenoid valve, 21: third flow control device, 22: second defrosting pipe, 30: controller, 31: suction pressure sensor, 32: pressure sensor, 100: air-conditioning apparatus, 101: air-conditioning apparatus, 102: air-conditioning apparatus, A: outdoor unit, B. C: indoor unit

The invention claimed is:

1. An air-conditioning apparatus comprising:

a main circuit formed by sequentially connecting, through pipes, a compressor, an indoor heat exchanger, a first flow control valve corresponding to the indoor heat exchanger, a plurality of parallel heat exchangers connected in parallel with each other, and an accumulator to form at least a heating circuit, a first defrosting pipe configured to allow a part of refrigerant discharged from the compressor to branch off and flow therethrough, a liquid refrigerant transporting unit configured to transfer liquid refrigerant from the accumulator to the compressor, the liquid refrigerant transporting unit including a first bypass pipe which is configured to allow liquid refrigerant accumulated in the accumulator to return from a bottom of the accumulator to a suction pipe of the compressor and a bypass valve which controls a flow of the liquid refrigerant in the first bypass pipe by opening and closing, and an expansion valve configured to reduce a pressure of the refrigerant flowing out of the heat exchanger to be defrosted, wherein the air-conditioning apparatus is configured to perform a heating-defrosting operation where a specific one of the plurality of parallel heat exchangers is a heat exchanger to be defrosted and serves as a condenser while at least one parallel heat exchanger other than the heat exchanger to be defrosted serves as an evaporator, refrigerant whose saturation temperature is higher than 0 degrees Celsius flows through the specific one of the plurality of parallel heat exchangers serving as the condenser and then passes through the at least one parallel heat exchanger serving as the evaporator and is evaporated, and the liquid refrigerant transporting unit is configured to transfer the liquid refrigerant accumulated in the accumulator to the compressor through the first bypass pipe by opening the bypass valve, and the first defrosting pipe transfers the part of refrigerant discharged from the compressor to the heat exchanger to be defrosted.

2. The air-conditioning apparatus of claim 1, wherein the liquid refrigerant transporting unit includes a first expansion device provided to the first bypass pipe, and the first expansion device is configured by connecting the bypass valve and an expansion device in series.

3. The air-conditioning apparatus of claim 1, wherein the first defrosting pipe is provided with a third expansion device configured to reduce a pressure of the refrigerant discharged by the compressor in the heating-defrosting operation.

4. The air-conditioning apparatus of claim 3, wherein the liquid refrigerant transporting unit includes a first expansion device including the bypass valve provided to the first bypass pipe, and the liquid refrigerant transporting unit transfers the liquid refrigerant accumulated in the accumulator from the accumulator to the compressor, through the first bypass pipe, the first expansion device in the first bypass pipe, the suction pipe of the compressor, the compressor, a discharge pipe of the compressor, the first defrosting pipe, and the third expansion device in the first defrosting pipe.

5. The air-conditioning apparatus of claim 1, wherein the liquid refrigerant transporting unit includes a second bypass pipe configured to allow a part of the refrigerant discharged from the compressor in the heating-defrosting operation to flow into the accumulator, and a second expansion device including a valve provided to the second bypass pipe.

6. The air-conditioning apparatus of claim 1, further comprising a second defrosting pipe configured to allow the refrigerant flowing out of the heat exchanger to be defrosted in the heating-defrosting operation to flow into the main circuit on an upstream side of the at least one parallel heat exchanger other than the heat exchanger to be defrosted.

7. The air-conditioning apparatus of claim 4, further comprising a second defrosting pipe configured to allow the refrigerant flowing out of the heat exchanger to be defrosted in the heating-defrosting operation to flow into the main circuit on an upstream side of the at least one parallel heat exchanger other than the heat exchanger to be defrosted, wherein in the heating-defrosting operation, a pressure of the refrigerant in the heat exchanger to be defrosted is controlled by at least the third expansion device or the expansion valve.

8. The air-conditioning apparatus of claim 7, wherein in the heating-defrosting operation, the pressure of the refrigerant in the heat exchanger to be defrosted is controlled to be equivalent to a saturation temperature within a range of 0 degrees Celsius to 10 degrees Celsius.

9. The air-conditioning apparatus of claim 1, wherein in the heating-defrosting operation, the liquid refrigerant transporting unit controls the liquid refrigerant transferred from the accumulator such that a mean density of the refrigerant in the heat exchanger to be defrosted is equivalent to a quality ranging from 0 to 0.2 at a refrigerant pressure corresponding to a saturated liquid temperature of 0 degrees Celsius.

10. The air-conditioning apparatus of claim 1, wherein in the heating-defrosting operation, the liquid refrigerant transporting unit transfers the liquid refrigerant from the accumulator to the compressor if an outdoor air temperature is lower than or equal to a specified value.

11. The air-conditioning apparatus of claim 1, wherein in the heating-defrosting operation, the liquid refrigerant transporting unit transfers the liquid refrigerant from the accumulator to the compressor if a suction pressure of the compressor drops to a specified value or below.

12. The air-conditioning apparatus of claim 1, wherein in the heating-defrosting operation, the liquid refrigerant transporting unit controls an amount of liquid refrigerant transferred from the accumulator such that a temperature, or a degree of superheat, of the refrigerant discharged from the compressor is greater than or equal to a specified value.

13. The air-conditioning apparatus of claim 1, wherein in the heating-defrosting operation, the liquid refrigerant transporting unit controls the amount of liquid refrigerant transferred from the accumulator such that a shell temperature of the compressor is higher than or equal to a specified value.

14. The air-conditioning apparatus of claim 5, wherein the liquid refrigerant transporting unit includes a first expansion device including the bypass valve provided to the first bypass pipe, and if a suction pressure of the compressor drops to a specified value or below even when the liquid refrigerant is supplied from the accumulator through the first bypass pipe to the heat exchanger to be defrosted, the liquid refrigerant transporting unit allows a part of the refrigerant discharged from the compressor to flow through the second bypass pipe into the accumulator.

15. The air-conditioning apparatus of claim 1, further comprising a pressure sensor configured to detect a pressure of the refrigerant transported to the heat exchanger to be defrosted, wherein a refrigerant transfer control operation is performed where the liquid refrigerant transporting unit transfers the refrigerant to the compressor when a value detected by the pressure sensor unit reaches a predetermined value.

16. The air-conditioning apparatus of claim 15, wherein the predetermined value is set to be equivalent to a saturation temperature within a range of 0 degrees Celsius to 10 degrees Celsius.

17. An air-conditioning apparatus comprising:

a main circuit formed by sequentially connecting, through pipes, a compressor, an indoor heat exchanger, a first flow control valve corresponding to the indoor heat exchanger, a plurality of parallel heat exchangers connected in parallel with each other, and an accumulator to form at least a heating circuit, a first defrosting pipe configured to allow a part of refrigerant discharged from the compressor to branch off and flow therethrough, a liquid refrigerant transporting unit configured to transfer liquid refrigerant from the accumulator to the compressor, the liquid refrigerant transporting unit including a first bypass pipe which is configured to allow liquid refrigerant accumulated in the accumulator to return from a bottom of the accumulator to a suction pipe of the compressor and a bypass valve which controls a flow of the liquid refrigerant in the first bypass pipe by opening and closing, an expansion valve configured to reduce a pressure of the refrigerant flowing out of the heat exchanger to be defrosted, a second defrosting pipe connected to the main circuit, and a solenoid valve provided to the second defrosting pipe, wherein the air-conditioning apparatus is configured to perform a heating-defrosting operation where a specific one of the plurality of parallel heat exchangers is a heat exchanger to be defrosted and serves as a condenser while at least one parallel heat exchanger other than the heat exchanger to be defrosted serves as an evaporator, the liquid refrigerant transporting unit is configured to transfer the liquid refrigerant accumulated in the accumulator to the compressor through the first bypass pipe by opening the bypass valve, and the first defrosting pipe transfers the part of refrigerant discharged from the compressor to the heat exchanger to be defrosted, and the part of refrigerant flows through the specific one of the plurality of heat exchangers serving as the condenser and flows through the second defrosting pipe via the solenoid valve, and then passes through the expansion valve and the at least one parallel heat exchanger serving as the evaporator and is evaporated.

18. The air-conditioning apparatus of claim 17, wherein the bypass valve is configured to be closed when the apparatus is not in the heating-defrosting operation.

19. The air-conditioning apparatus of claim 17, wherein the second defrosting pipe branches the part of the refrigerant from the main circuit after passing through the heat exchanger to be defrosted and returns the part of the refrigerant to the main circuit between the indoor heat exchanger and the plurality of parallel heat exchangers after passing through the expansion device.

20. The air-conditioning apparatus of claim 1, wherein the bypass valve is configured to be closed when the apparatus is not in the heating-defrosting operation.

* * * * *